US009205312B2

(12) United States Patent
Zimmerman et al.

(10) Patent No.: US 9,205,312 B2
(45) Date of Patent: Dec. 8, 2015

(54) GOLF CLUB HAVING REMOVABLE WEIGHT

(71) Applicant: Acushnet Company, Fairhaven, MA (US)

(72) Inventors: Gery M. Zimmerman, Fallbrook, CA (US); Thomas O. Bennett, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 165 days.

(21) Appl. No.: 14/145,344

(22) Filed: Dec. 31, 2013

(65) Prior Publication Data

US 2014/0113742 A1 Apr. 24, 2014

Related U.S. Application Data

(63) Continuation-in-part of application No. 13/337,910, filed on Dec. 27, 2011, now Pat. No. 8,684,863.

(51) Int. Cl.
*A63B 53/04* (2015.01)
*A63B 53/06* (2015.01)

(52) U.S. Cl.
CPC ..... *A63B 53/06* (2013.01); *A63B 53/04* (2013.01); *A63B 53/0466* (2013.01); *A63B 53/047* (2013.01); *A63B 53/0487* (2013.01); *A63B 2053/0408* (2013.01); *A63B 2053/0433* (2013.01); *A63B 2053/0437* (2013.01); *A63B 2053/0491* (2013.01)

(58) Field of Classification Search
CPC ..... A63B 53/06; A63B 53/0466; A63B 53/0487; A63B 53/047; A63B 2053/0433; A63B 2053/0491; A63B 2053/0437; A63B 2053/0408; A63B 53/04
USPC ..... 473/324–350, 287–292
See application file for complete search history.

(56) References Cited

U.S. PATENT DOCUMENTS

| | | | |
|---|---|---|---|
| 1,133,129 | A | 3/1915 | Govan |
| 1,167,106 | A | 1/1916 | Palmer |
| 1,322,182 | A | 11/1919 | Duncan |
| 1,534,600 | A | 4/1925 | Mattern |
| 2,214,356 | A | 9/1940 | Wettlaufer |
| 2,517,245 | A | 8/1950 | Scott |
| 3,064,980 | A | 11/1962 | Steiner |

(Continued)

FOREIGN PATENT DOCUMENTS

| | | | |
|---|---|---|---|
| GB | 2133295 | A | 7/1984 |
| JP | 10137374 | A | 5/1998 |

(Continued)

*Primary Examiner* — Sebastiano Passaniti
(74) *Attorney, Agent, or Firm* — Kevin N. McCoy

(57) ABSTRACT

A golf club head, comprising a weight mount comprising a first portion and a second portion, a first weight member and a second weight member, each configured to be coupled to said weight mount, a single fastener configured to force said first weight member to translate in a first direction towards said first portion of said weight mount and said second weight member to translate in a second direction towards said second portion of said weight mount, wherein said first direction is different than said second direction, and wherein said fastener, said first portion of said weight mount, and said second portion of said weight mount are configured to limit said first weight member and said second weight member from moving relative to said weight mount.

20 Claims, 31 Drawing Sheets

(56) References Cited

U.S. PATENT DOCUMENTS

| | | | | |
|---|---|---|---|---|
| 3,212,783 | A | 10/1965 | Bradley et al. | |
| 3,220,733 | A | 11/1965 | Saleeby | |
| 3,466,047 | A | 9/1969 | Rodia et al. | |
| 3,556,533 | A | 1/1971 | Hollis | |
| 3,652,094 | A | 3/1972 | Glover | |
| 3,692,306 | A | 9/1972 | Glover | |
| 4,043,563 | A | 8/1977 | Churchward | |
| 4,052,075 | A | 10/1977 | Daly | |
| 4,085,934 | A | 4/1978 | Churchward | |
| 4,340,230 | A | 7/1982 | Churchward | |
| 4,423,874 | A | 1/1984 | Stuff, Jr. | |
| 4,602,787 | A | 7/1986 | Sugioka et al. | |
| 4,795,159 | A | 1/1989 | Nagamoto | |
| 4,867,458 | A | 9/1989 | Sumikawa et al. | |
| 4,869,507 | A | 9/1989 | Sahm | |
| 4,883,274 | A * | 11/1989 | Hsien | 473/335 |
| 5,050,879 | A | 9/1991 | Sun et al. | |
| 5,154,424 | A | 10/1992 | Lo | |
| 5,230,509 | A | 7/1993 | Chavez | |
| 5,297,794 | A | 3/1994 | Lu | |
| 5,316,305 | A | 5/1994 | McCabe | |
| 5,441,274 | A * | 8/1995 | Clay | 473/201 |
| 5,518,243 | A | 5/1996 | Redman | |
| 5,720,674 | A | 2/1998 | Galy | |
| 5,795,245 | A | 8/1998 | Chang et al. | |
| 5,916,042 | A | 6/1999 | Reimers | |
| 5,935,019 | A | 8/1999 | Yamamoto | |
| 5,947,840 | A | 9/1999 | Ryan | |
| 5,967,905 | A | 10/1999 | Nakahara et al. | |
| 6,056,649 | A | 5/2000 | Imai | |
| 6,089,994 | A | 7/2000 | Sun | |
| 6,123,627 | A | 9/2000 | Antonious | |
| 6,162,132 | A | 12/2000 | Yoneyama | |
| 6,217,461 | B1 | 4/2001 | Galy | |
| 6,348,014 | B1 | 2/2002 | Chiu | |
| 6,379,265 | B1 | 4/2002 | Hirakawa et al. | |
| 6,409,612 | B1 | 6/2002 | Evans et al. | |
| 6,458,044 | B1 | 10/2002 | Vincent et al. | |
| 6,648,772 | B2 | 11/2003 | Vincent et al. | |
| 6,773,360 | B2 | 8/2004 | Willett et al. | |
| 6,860,818 | B2 | 3/2005 | Mahaffey et al. | |
| 6,881,158 | B2 | 4/2005 | Yang et al. | |
| 6,988,960 | B2 | 1/2006 | Mahaffey et al. | |
| 7,121,956 | B2 | 10/2006 | Lo | |
| 7,153,220 | B2 | 12/2006 | Lo | |
| 7,166,040 | B2 | 1/2007 | Hoffman et al. | |
| 7,166,041 | B2 | 1/2007 | Evans | |
| 7,186,190 | B1 | 3/2007 | Beach et al. | |
| 7,189,169 | B2 | 3/2007 | Billings | |
| 7,223,180 | B2 | 5/2007 | Willett et al. | |
| 7,294,065 | B2 | 11/2007 | Liang et al. | |
| 7,326,472 | B2 | 2/2008 | Shimazaki et al. | |
| 7,407,447 | B2 | 8/2008 | Beach et al. | |
| 7,410,425 | B2 | 8/2008 | Willett et al. | |
| 7,410,426 | B2 | 8/2008 | Willett et al. | |
| 7,419,441 | B2 | 9/2008 | Hoffman et al. | |
| 7,448,963 | B2 | 11/2008 | Beach et al. | |
| 7,452,285 | B2 | 11/2008 | Chao et al. | |
| 7,578,753 | B2 | 8/2009 | Beach et al. | |
| 7,604,548 | B2 | 10/2009 | Cole | |
| 7,670,235 | B2 | 3/2010 | Lo | |
| 7,717,804 | B2 | 5/2010 | Beach et al. | |
| 7,758,452 | B2 | 7/2010 | Soracco | |
| 7,771,290 | B2 | 8/2010 | Bezilla et al. | |
| 7,775,905 | B2 | 8/2010 | Beach et al. | |
| 8,043,167 | B2 | 10/2011 | Boyd et al. | |
| 8,092,316 | B2 | 1/2012 | Breier et al. | |
| 8,105,175 | B2 | 1/2012 | Breier et al. | |
| 8,182,363 | B2 | 5/2012 | Bezilla et al. | |
| 8,192,302 | B2 | 6/2012 | Knutson et al. | |
| 8,292,757 | B2 | 10/2012 | Soracco | |
| 8,388,465 | B2 | 3/2013 | De La Cruz et al. | |
| 8,435,135 | B2 | 5/2013 | Stites et al. | |
| 8,540,589 | B2 | 9/2013 | Bezilla et al. | |
| 8,684,863 | B2 * | 4/2014 | Bezilla et al. | 473/334 |
| 9,095,753 | B2 * | 8/2015 | Bezilla et al. | |
| 2003/0148818 | A1 | 8/2003 | Myrhum et al. | |
| 2006/0058112 | A1 | 3/2006 | Haralason et al. | |
| 2006/0100029 | A1 | 5/2006 | Lo | |
| 2006/0122004 | A1 | 6/2006 | Chen et al. | |
| 2006/0217216 | A1 | 9/2006 | Iizuka | |
| 2007/0155534 | A1 | 7/2007 | Tsai et al. | |
| 2008/0132353 | A1 | 6/2008 | Hsiao | |

FOREIGN PATENT DOCUMENTS

| | | | |
|---|---|---|---|
| JP | 10234902 | A | 9/1998 |
| JP | 10248964 | A | 9/1998 |
| JP | 11319167 | A | 11/1999 |
| JP | 2000176059 | A | 6/2000 |
| JP | 2001000606 | A | 1/2001 |
| JP | 2001149514 | A | 6/2001 |
| JP | 2002011124 | A | 1/2002 |
| JP | 2005160947 | A | 6/2005 |
| JP | 2006000435 | A | 1/2006 |
| JP | 2006081862 | A | 3/2006 |
| JP | 2006122334 | A | 5/2006 |
| JP | 2006187489 | A | 7/2006 |
| JP | 2006198251 | A | 8/2006 |
| JP | 2006239154 | A | 9/2006 |

* cited by examiner

GOLF CLUB HAVING REMOVABLE WEIGHT

RELATED APPLICATIONS

The current application is a continuation-in-part (CIP) of U.S. patent application Ser. No. 13/337,910, filed on Dec. 27, 2011, currently pending, the disclosure of which is incorporated by reference in its entirety.

FIELD OF THE INVENTION

The invention relates to golf clubs, and more particularly, to golf club heads having a removable weight.

BACKGROUND OF THE INVENTION

The trend of lengthening golf courses to increase their difficulty has resulted in a high percentage of amateur golfers constantly searching for ways to achieve more distance from their golf shots. The golf industry has responded by providing golf clubs specifically designed with distance and accuracy in mind. The size of wood-type golf club heads has generally been increased while multi-material construction and reduced wall thicknesses have been included to provide more mass available for selective placement through the head. The discretionary mass placement has allowed the club to possess a higher moment of inertia (MOI), which translates to a greater ability to resist twisting during off-center ball impacts and less of a distance penalty for those off-center ball impacts.

Various methods are used to selectively locate mass throughout golf club heads, including thickening portions of the body casting itself or strategically adding separate weight element during the manufacture of the club head. An example, shown in U.S. Pat. No. 7,186,190, discloses a golf club head comprising a number of moveable weights attached to the body of the club head. The club head includes a number of threaded ports into which the moveable weights are screwed. Though the mass characteristics of the golf club may be manipulated by rearranging the moveable weights, the cylindrical shape of the weights and the receiving features within the golf club body necessarily moves a significant portion of the mass toward the center of the club head, which may not maximize the peripheral weight of the club head or the MOI.

Alternative approaches for selectively locating mass in a club head utilize composite multi-material structures. These composite structures utilize two, three, or more materials that have different physical properties including different densities. An example of this type of composite club head is shown in U.S. Pat. No. 5,720,674. The club head comprises an arcuate portion of high-density material bonded to a recess in the back-skirt. Because composite materials like those found in the club head must be bonded together, for example by welding, swaging, or using bonding agents such as epoxy, they may be subject to delamination or corrosion over time. This component delamination or corrosion results in decreased performance in the golf club head and can lead to club head failure.

Though many methods of optimizing the mass properties of golf club heads exist, there remains a need in the art for a golf club head comprising at least a removable weight having secure attachment and a low-profile so that the weight does not protrude into the center of the club head and negatively affect the location of the center of gravity.

SUMMARY OF THE INVENTION

The systems, methods, and devices described herein have innovative aspects, no single one of which is indispensable or solely responsible for their desirable attributes. Without limiting the scope of the claims, some of the advantageous features will now be summarized.

The present technology is directed to a golf club head having a portion comprising at least one removable weight member. The removable weight member is preferably located toward the back of the sole and may be substantially centered between the heel and toe of the club head. Alternatively, the removable weight member may be situated toward the back and heel or toward the back and toe of the club head, depending on the desired mass characteristics, e.g., center of gravity, loft and moment of inertia, of the club head.

One non-limiting embodiment of the present technology includes a golf club head comprising a hosel, a ball striking face, a sole extending aftward from a lower edge of said striking face, a crown extending aftward from an upper edge of said striking face, a skirt extending between said sole and said crown, a weight mount disposed on at least one of the sole, the crown and the skirt, wherein said weight mount comprises a first end and a second end, said first end opposite said second end, where said weight mount comprises a first undercut located at said first end, a second undercut located at said second end, and a support surface located between said first end and said second end, a first weight member and a second weight member, said first weight member and said second weight member each including an abutment surface, wherein at least a portion of said abutment surface of said first weight member is received in said first undercut, wherein at least a portion of said abutment surface of said second weight member is received in said second undercut, a fastener configured to force said first weight member towards said first undercut and said second weight member towards said second undercut, wherein said first undercut, said second undercut, and said fastener are configured to limit said first weight member and said second weight member from moving relative to said weight mount.

In an additional non-limiting embodiment, said first and second weight members each comprise a tapered portion, said tapered portion of said first weight member opposite said abutment surface of said first weight member and said tapered portion of said second weight member opposite said abutment surface of said second weight member.

An additional non-limiting embodiment further comprises a retainer located between said first weight member and said second weight member, wherein said support surface comprises a threaded bore configured to engage said fastener, wherein said retainer comprises a fastener bore configured to receive a portion of said fastener, wherein said retainer comprises a first tapered engagement portion configured to engage said tapered portion of said first weight member and a second tapered engagement portion configured to engage said tapered portion of said second weight member, wherein said retainer is configured to force said first weight member towards said first undercut and said second weight member towards said second undercut, and wherein said first undercut is configured to force said first weight member towards said support surface and said second undercut is configured to force said second weight member towards said support surface.

In an additional non-limiting embodiment, said first undercut comprises a bevel, said second undercut comprises a bevel, said abutment surface of said first weight member is angled and abuts at least a portion of said first undercut, and said second abutment surface of said second weight member is angled and abuts at least a portion of said second undercut.

In an additional non-limiting embodiment, said first weight member comprises a mass different than the mass of said second weight member and wherein said first weight member and said second weight member are interchangeable, providing an adjustment of the location of the center of gravity of said golf club head.

In an additional non-limiting embodiment, said first end of said weight mount is located closer to said striking face of said golf club head and said second end of said weight mount is located aftward of said first end of said weight mount.

In an additional non-limiting embodiment, said golf club head comprises a toe and a heel, wherein said first end of said weight mount is located closer to said toe of said golf club head and wherein said second end of said weight mount is located closer to said heel of said golf club head.

In an additional non-limiting embodiment, said fastener is rotatably coupled to said retainer wherein said fastener is configured to translate along with said retainer but rotate relative to said retainer.

In an additional non-limiting embodiment, said fastener is arranged substantially perpendicular to said support surface, said fastener is configured to force said retainer towards said support surface, and wherein said first weight member and said second weight member move in directions substantially perpendicular to the translation of said fastener and said first weight member moves in a direction substantially opposite that of said second weight member when said fastener is tightened into a locked position.

In an additional non-limiting embodiment, said first and second weight members each have a generally polygonal perimeter shape.

In an additional non-limiting embodiment, said fastener comprises a cam rotatably coupled to said golf club head, said cam located between said first weight member and said second weight member, wherein said first and second weight member each comprise a cam engagement portion, said cam engagement portion of said first weight member opposite said abutment surface of said first weight member and said cam engagement portion of said second weight member opposite said abutment surface of said second weight member, wherein said cam is configured to rotate between a locked position and an unlocked position, wherein said cam is configured to contact said cam engagement portion of said first weight member and said cam engagement portion of said second weight member, forcing said first weight member and said second member towards said first undercut and said second undercut when said cam is rotated from an unlocked position to a locked position, wherein said first undercut, said second undercut, and said cam are configured to limit said first weight member and said second weight member from moving relative to said weight mount when said cam is in said locked position, and wherein said first weight member and said second weight member are removable when said cam is in an unlocked position.

In an additional non-limiting embodiment, said cam comprises a dynamic portion, said dynamic portion extending further outward towards said first and second weight members when in said locked position than when said cam is in said unlocked position.

In an additional non-limiting embodiment, said support surface comprises a cam bore, wherein said cam comprises a body portion connected to said dynamic portion, wherein a portion of said body of said cam passes through said cam bore, and wherein said cam comprises a cam retaining member configured to prevent said cam from becoming disconnected from said golf club head.

In an additional non-limiting embodiment, at least one of said cam engaging portions of said first and second weight members comprises a locking feature configured to lock said cam in said locked position, and wherein said locking feature comprises a recess configured to receive said dynamic portion of said cam when said cam is in said locked position.

In an additional non-limiting embodiment, said first undercut comprises a bevel, said second undercut comprises a bevel, said abutment surface of said first weight member is angled and abuts at least a portion of said first undercut, and said second abutment surface of said second weight member is angled and abuts at least a portion of said second undercut.

In an additional non-limiting embodiment, said first weight member comprises a mass different than the mass of said second weight member and wherein said first weight member and said second weight member are interchangeable, providing an adjustment of the location of center of gravity of said golf club head, by rotating said cam to said unlocked position.

In an additional non-limiting embodiment, a golf club head, comprises a hosel, a ball striking face, a weight mount, a first weight member and a second weight member, each configured to be coupled to said weight mount, a single fastener configured to translate relative to said weight mount and engage said first weight member and said second weight member, coupling both said first weight member and said second weight member to said weight mount simultaneously, wherein said first weight member slides in a direction substantially perpendicular to said translation of said fastener, wherein said first weight member slides in a direction substantially perpendicular to said translation of said fastener.

In an additional non-limiting embodiment, said weight mount comprises a threaded bore, said single fastener is configured to engage said threaded bore, and said single fastener is configured to translate as said fastener rotates inside said threaded bore.

In an additional non-limiting embodiment, said weight mount comprises a first undercut and a second undercut, wherein said first weight member and said second weight member each include an abutment surface, wherein at least a portion of said abutment surface of said first weight member is received in said first undercut, wherein at least a portion of said abutment surface of said second weight member is received in said second undercut, wherein said first undercut, said second undercut, and said fastener are configured to prevent said first weight member and said second weight member from moving relative to said weight mount when said fastener is tightened down in said threaded bore, wherein said first weight member slides in a direction different than that of said second weight member as said fastener is tightened down in said threaded bore.

In an additional non-limiting embodiment, a golf club head comprises a weight mount comprising a first portion and a second portion, a first weight member and a second weight member, each configured to be coupled to said weight mount, a single fastener configured to force said first weight member to translate in a first direction towards said first portion of said weight mount and said second weight member to translate in a second direction towards said second portion of said weight mount, wherein said first direction is different than said second direction, and wherein said fastener, said first portion of said weight mount, and said second portion of said weight mount are configured to limit said first weight member and said second weight member from moving relative to said weight mount.

DETAILED DESCRIPTION

Figure 1:
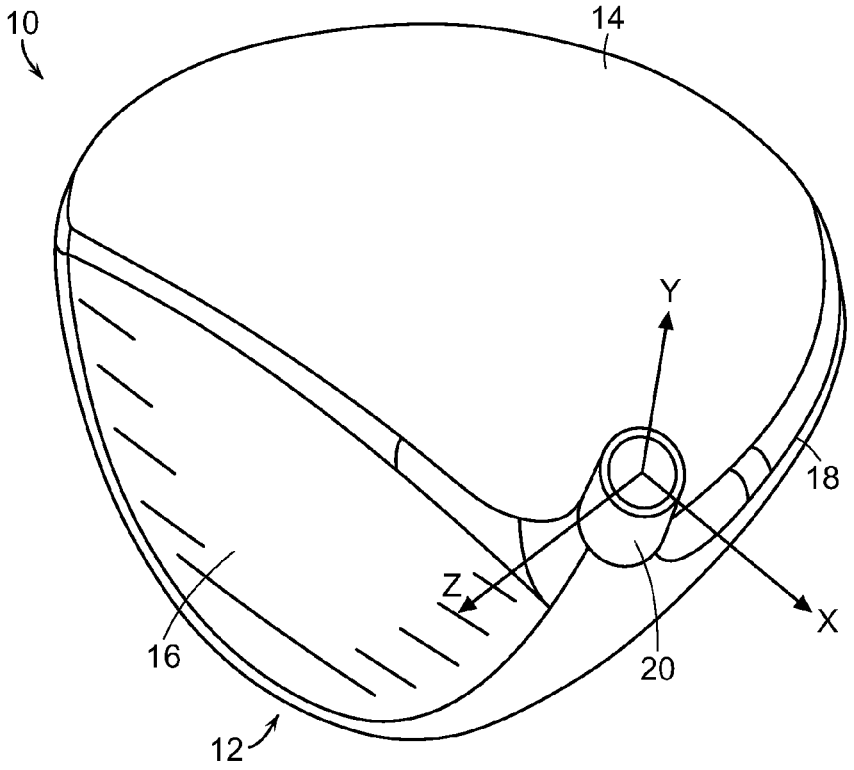
FIG. 1 is a perspective view of a golf club head.
Figure 2:
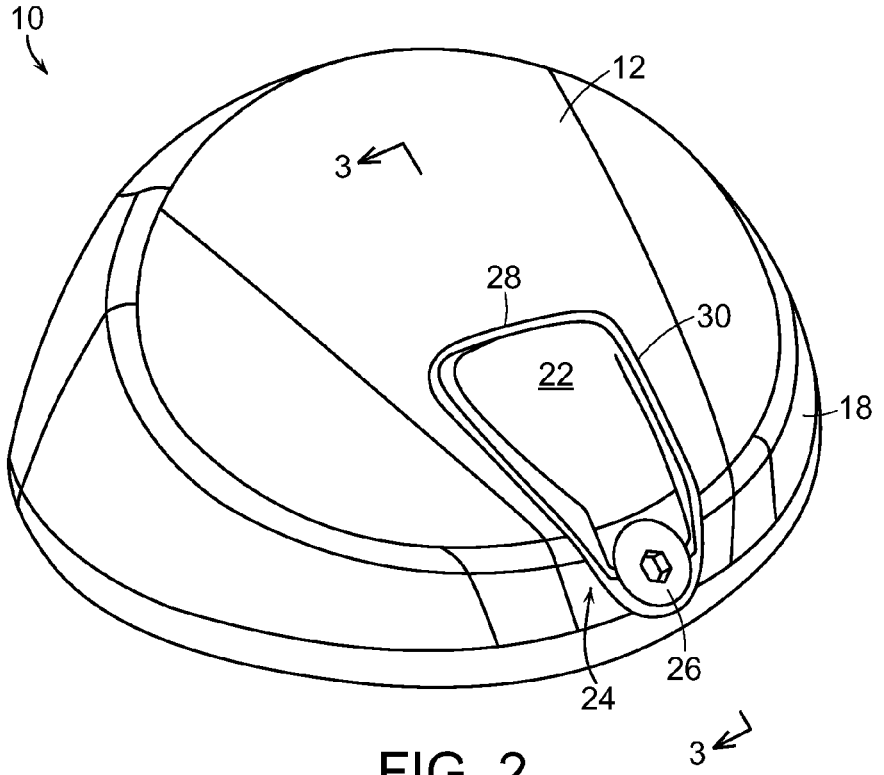
FIG. 2 is a perspective view of an aft portion of a golf club head of the present invention including a removable weight member.
Figure 3:
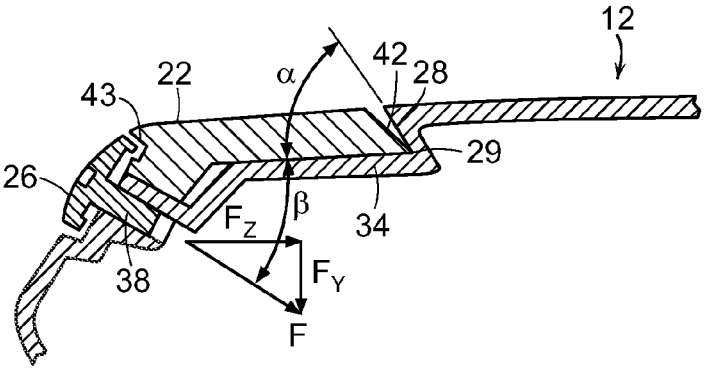
FIG. 3 is a cross-sectional view of a portion of the golf club head and removable weight member of FIG. 2.
Figure 4:
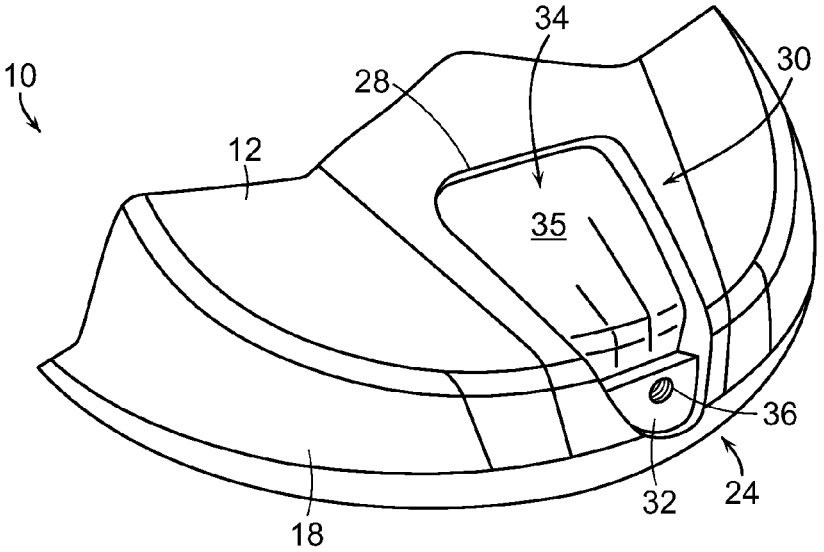
FIG. 4 is a perspective view of an aft portion of the golf club head of FIG. 2 without the removable weight member.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

The golf club head of the present invention is preferably hollow, such as a metal wood type golf club head, but may include any club head type, such as iron-type club heads. The golf club head generally includes a hosel, a hitting face, a crown, a sole, and a skirt that combine to define a hollow interior cavity.

The inventive golf club head also has a low profiled weight member disposed on a portion of the club head, and preferably on the crown, sole and/or skirt of the golf club head. The embodiments described below are generally illustrated so that the weight member is attached at least partially to the sole for convenience. However, as will be appreciated by a person having ordinary skill, weight mounts and weight members having the same structures as those described may be located on any portion of the golf club head, such as the crown and/or skirt.

An equivalent plan area ($Area_{EP}$) of the weight member is preferably greater than approximately 200 $mm^2$ where equivalent plan area is:

$$Area_{EP}=V/T_{ave}$$

where V is the volume of the weight member and T is an average thickness taken generally normal to an outer surface of the weight member and toward the interior of the golf club head. In weight members including an elongate fastener that extends toward an interior of the club head, the average thickness is calculated disregarding the elongate fastener. In each of the embodiments described below, it is preferred that the mass of the weight member range between 2 grams and 30 grams and that the equivalent plan area be greater than approximately 200 $mm^2$ and even more preferably greater than 250 $mm^2$. Also, weight member preferably has an average thickness that is less than about 8 mm, and more preferably less than about 6 mm.

An exemplary club head is shown FIGS. 1-4. Club head 10 includes a sole 12, a crown 14, a hitting face 16, a skirt 18, a hosel 20, and a weight member 22. Sole 12 generally provides the lower surface of golf club head 10 when the club head is placed in an address position. Sole 12 includes a weight mount 24, which is configured to couple weight member 22 to sole 12. In the present embodiment, mount 24 is a recessed portion of sole 12 that is shaped to complement the shape of weight member 22. For example, weight member 22 is generally trapezoidal in plan shape and weight mount 24 includes a generally trapezoidally-shaped recess.

Mount 24 includes a fastener 26, a bevel 28 and a receiver 30. Mount 24 is constructed to clamp weight member 22 between bevel 28 and fastener 26. In particular, mount 24 is constructed so that when weight member 22 is located on mount 24, and fastener 26 is tightened, fastener 26 forces weight member 22 at least partially laterally against bevel 28. As a result, a portion of weight member 22 is drawn tighter against sole 12 by the interaction between the weight member and the bevel.

In the present embodiment, receiver 30 is a recessed portion of sole 12 and skirt 18 and aligns weight member 22 relative to the remainder of the golf club head when weight member 22 is disposed in mount 24. Receiver 30 includes a fastener portion 32 and a support portion 34. Fastener portion 32 includes a threaded bore 36 that receives a threaded shank 38 of fastener 26. Support portion 34 includes a generally planar support surface 35 that extends between fastener portion 32 and bevel 28 and provides support for weight member 22 when weight member 22 is disposed in receiver 30. The recessed configuration of receiver 30 also limits the movement of weight member 22 laterally relative to bevel 28.

Bevel 28 forms an undercut portion of mount 24 that receives a portion of weight member 22. Bevel 28 extends from support surface 35 at a location that is spaced from fastener 26 and is angled relative to support surface 35 by a bevel angle α that is an acute angle. Bevel angle α is acute so that as weight member 22 is forced into bevel 28, weight member 22 is forced against support surface 35. Bevel angle α is preferably between about 25° and about 65°, and more preferably between about 35° and about 55° relative to support surface 35, and in particular relative to a planar portion of support surface 35 that is adjacent a base 29 of bevel 28.

Weight member 22 includes an angled abutment surface 42 and a fastener engagement feature 43. Angled abutment surface 42 is a surface that complements the shape of bevel 28 of mount 24 and that abuts bevel 28 when weight member 22 is installed on mount 24. Bevel 28 and abutment surface 42 are angled so that as weight member 22 is forced into abutment with bevel 28 a force component along the abutting surfaces causes weight member 22 to slide against bevel 28 and to be forced against sole 12.

Fastener 26 is oriented so that as it is tightened in club head 10 it forces weight member 22 toward bevel 28. Threaded bore 36 is angled relative to support surface 35 so that interaction between fastener 26 and weight member 22 causes weight member 22 to move laterally, generally parallel to support surface 35, when fastener 26 is tightened. Fastener 26 engages club head 10 at a coupling angle β, relative to support surface 35, which has a magnitude that is less than 90° so that at least a component of the force applied by tightening fastener 26 is directed toward bevel 28, as shown by force component Fz. Preferably, coupling angle is less than 45° so that the Fz forms a larger force component than Fy, which is generally normal to support surface 35.

Mount 24 is preferably located in an aft portion of club head 10 so that weight member 22 is positioned behind and below the center of gravity of club head 10 without weight member 22. The inclusion of weight member 22 in this location aids in moving the center of gravity of the club head rearward and lower than the club head without the weight member.

Figure 5:
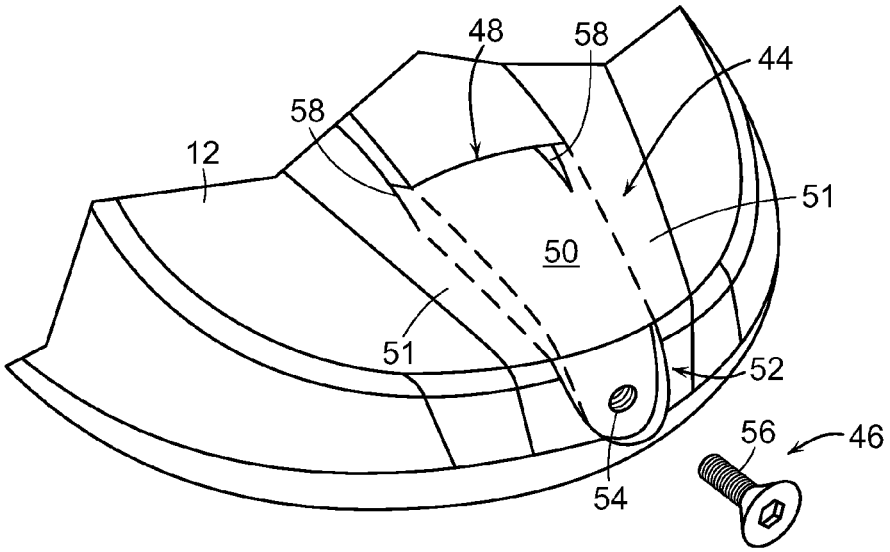
FIG. 5 is a perspective view of an alternative construction of the aft portion of the golf club of FIG. 4 without a removable weight member.

Referring to FIG. 5, another embodiment of a mount 44 will be described. Mount 44 is similar to mount 24 of the previous embodiment, but does not include a recess for receiving the weight member so that a support surface 50 is flush with the laterally adjacent portions 51 of the sole. Mount 44 is configured to clamp weight member 22 (illustrated by dashed lines) between a bevel 48 and a fastener 46. In particular, when weight member 22 is located on mount 44, and fastener 46 is tightened, the interaction between fastener 46 and weight member 22 forces weight member 22 at least partially laterally and against bevel 48. Forcing weight member 22 against bevel 48 causes weight member 22 to slide along bevel 48 and into the undercut formed by bevel 48 so that weight member 22 is forced against support surface 50. As a result, weight member 22 is forced tightly against sole 12 by the angled interface interaction between the weight member and the bevel.

Mount 44 includes fastener 46, bevel 48, support surface 50 and a fastener portion 52. A portion of the club head body defines bevel 48, support surface 50 and fastener portion 52. Support surface 50 extends between bevel 48 and fastener portion 52 and is a surface that abuts the underside of weight member 22 when it is installed in mount 44. Support surface 50 may be a generally planar surface, as shown, so that it complements a generally planar abutment surface of the weight member. Fastener portion 52 includes a threaded bore 54 that receives a threaded shank 56 of fastener 46.

Similar to the previous embodiment, bevel forms an undercut portion that receives a portion of the weight member. Bevel 48 extends outward from sole 12 and support surface 50 at a location that is spaced from fastener 46. Bevel 48 is angled relative to support surface 50 by a bevel angle α that is acute relative to support surface 50.

Mount 44 also includes lateral walls 58 that are located adjacent bevel 48. Lateral walls 58 extend toward fastener portion 52 and form alignment features for weight member 22 when it is disposed on mount 44. In particular, lateral walls limit relative lateral motion between weight member 22 and bevel 48 so that the portion of weight member 22 that engages bevel 48 remains in contact with bevel 48 when it is installed. Lateral walls 58 extend outward and away from support surface 50 so that they are raised relative to the support surface 50. The height of lateral walls 58 is preferably less than, or equal to, the height of bevel 48 from support surface 50. For example, lateral walls 58 have a height relative to support surface 50 that is about 25%-100% of the height of bevel 48. Preferably, the height of lateral walls 58 is about 50% of the height of bevel 48.

Referring now to FIGS. 6-9, another embodiment of a golf club head including a weight will be described. Golf club head 60 includes a sole 62, a crown 64, a hitting face, a skirt 68, a hosel, and a weight member 72. Sole 62 includes a weight mount 74, which is configured to couple weight member 72 to the club head. In the present embodiment, mount 74 is constructed flush with adjacent portions of sole 62 (i.e., not recessed), so that an abutment surface 76 of weight member 72 is approximately flush with the adjacent portions of sole 62.

Mount 74 generally includes fastener 78, bevel 80, a support surface 82 and a fastener portion 84. A portion of the club head body defines bevel 80, support surface 82 and fastener portion 84. A portion of sole 62 that extends between bevel 80 and fastener portion 84 forms support surface 82. Support surface 82 is generally illustrated by the dashed line, but is contiguous with the adjacent portions of sole 62. Support surface 82 is shaped to complement abutment surface 76 of weight member 72 so that it abuts the underside of weight member 72 when the weight member is installed in mount 74. Fastener portion 84 includes a threaded bore 86 that receives a threaded shank 88 of fastener 78. Fastener 78 extends into skirt 68 so that as it is tightened in threaded bore 86 it translates generally toward bevel 80. As a result, when weight member 72 is installed and fastener 78 is tightened, the weight member is translated toward bevel 80 and into the undercut formed by bevel 80.

In the present embodiment, mount 74 includes an alignment feature in the form of tab 90 that interacts with weight member 72. Tab 90 is constructed as a tapered rib that extends aft-ward from bevel 80 toward fastener portion 84 and outward from support surface 82. Tab 90 tapers so that it narrows in the direction from bevel 80 toward fastener portion 84 and outward from support surface 82.

Weight member 72 includes an angled abutment surface 92 and a fastener engagement feature 94. Additionally, weight member 72 includes an alignment feature in the form of slot 96 that receives tab 90 when weight member 72 is installed on mount 74. Slot 96 is dimensioned so that as it receives tab 90 the tapered surfaces abut and limit relative movement between weight member 72 and the remainder of club head 60 while still allowing angled abutment surface 92 to slide along bevel 80. In particular as weight member 72 slides against bevel 80 it abuts tab 90. The interaction between the tapered tab 90 and the tapered slot 96 limits the amount that weight member 72 is able to slide against bevel 80 toward sole 62 and also limits relative lateral motion, i.e., relative motion generally in the heel-to-toe direction, between weight member 72 and bevel 80.

Angled abutment surface 92 is a surface that complements the shape of bevel 80 of mount 74 and that abuts bevel 80 when weight member 72 is installed on mount 74. Bevel 80 and abutment surface 92 are oriented so that as weight member 72 is forced into abutment with bevel 80 by the tightening of fastener 78, the abutment forces weight member 72 against sole 62.

Figure 6:
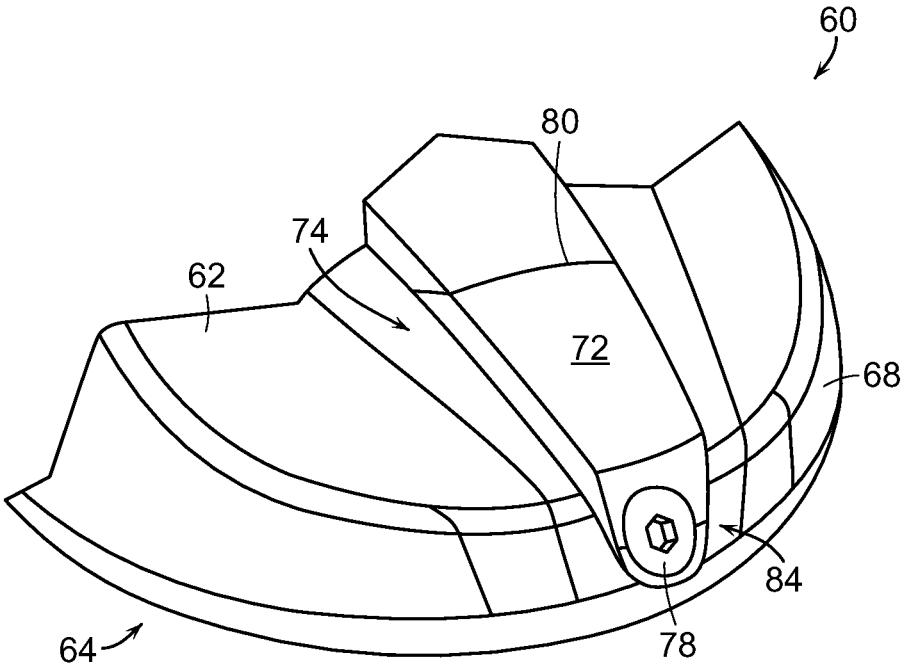
FIG. 6 is a perspective view of an aft portion of another embodiment of a golf club head including a removable weight member of the present invention.
Figure 7:
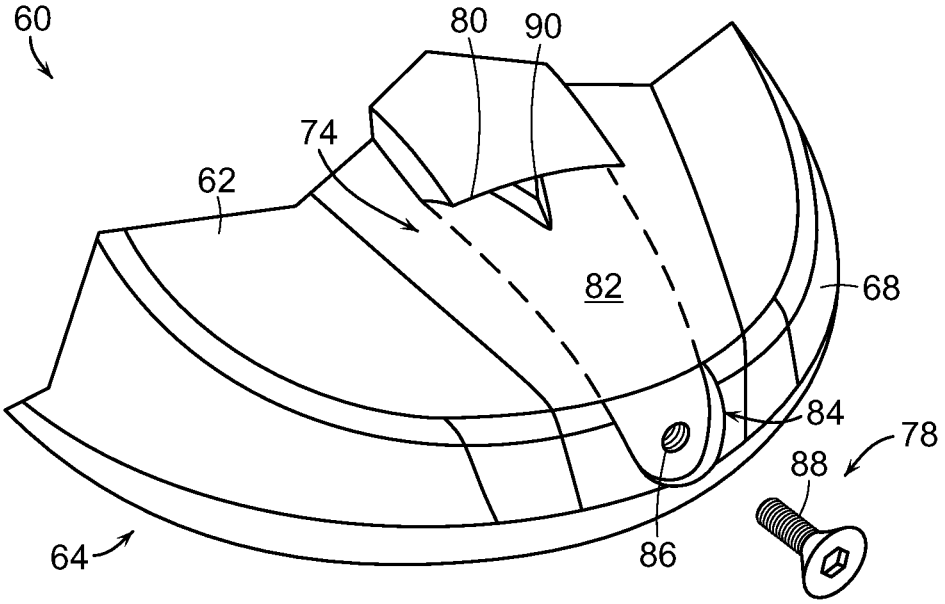
FIG. 7 is a perspective view of a portion of the golf club head of FIG. 6 without the removable weight member.
Figure 8:
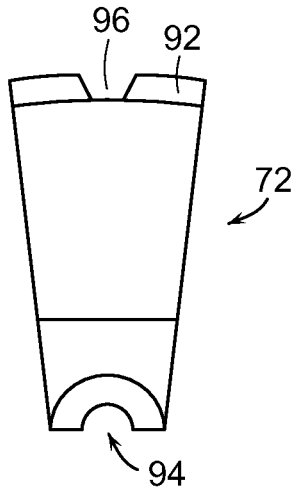
FIG. 8 is a plan view of an outer side of the removable weight member of FIG. 6.
Figure 9:
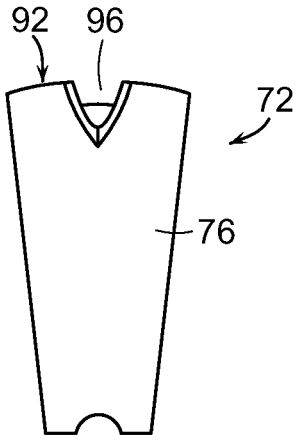
FIG. 9 is a plan view of an inner side of the removable weight member of FIG. 8.

Slot 96 is defined by weight member 72 and extends through a portion of angled abutment surface 76. In the present embodiment, the height of slot 96 is less than the thickness of weight member 72 so that it does not extend through the outer surface of weight member 72. As a result, and as shown in FIG. 6, neither slot 96 nor tab 90 are visible when weight member 72 is installed in club head 60.

Figure 10:
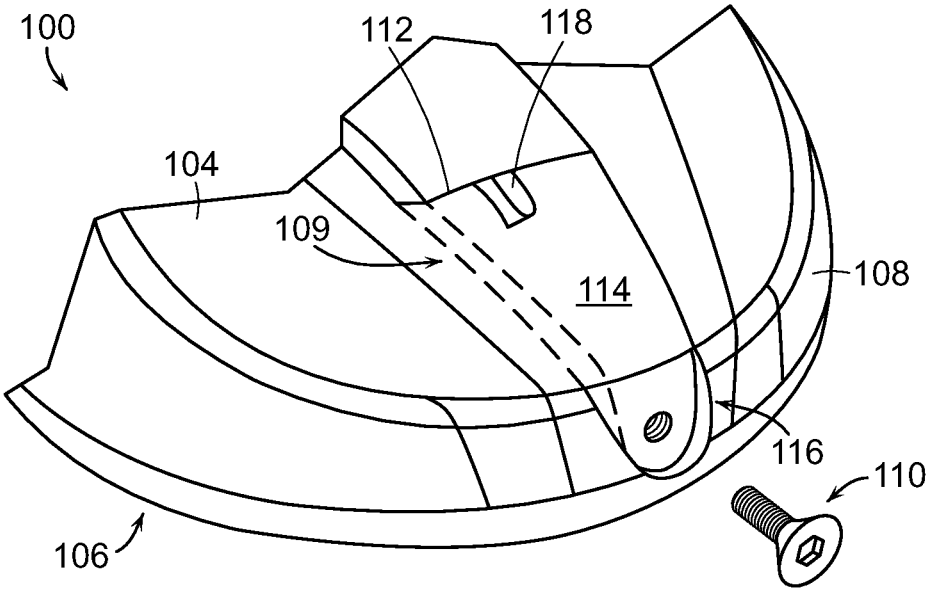
FIG. 10 is a perspective view of an alternative aft portion of a golf club head without the removable weight member.
Figure 11:
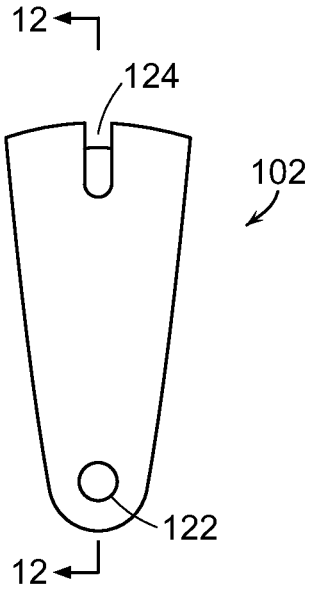
FIG. 11 is a plan view of an inner side of a removable weight member constructed to be installed on the golf club head of FIG. 10.
Figure 12:
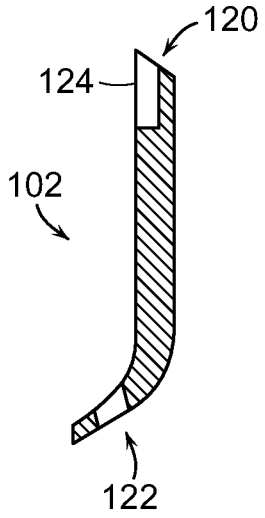
FIG. 12 is a cross-sectional view of the removable weight member of FIG. 11.

Another embodiment is illustrated in FIGS. 10-12, and includes a golf club head 100 that includes a weight member 102. The appearance of the mounted weight member 102 is nearly identical to the appearance of the golf club of FIG. 6, so the mounted weight member 102 is only illustrated in phantom in FIG. 10. In this embodiment, golf club head 100 has a structure similar to that of the previous embodiment with the exception of the alignment feature. In particular, weight member 102 has a structure similar to that of the previous embodiment, but the associated alignment feature is shaped and sized to complement the alignment feature of the weight mount included on golf club head 100.

Golf club head 100 includes a sole 104, a crown 106, a hitting face, a skirt 108, a hosel, and weight member 102. Sole 104 includes a weight mount 109, which is configured to couple weight member 102 and sole 104. In the present embodiment, mount 109 has a structure similar to that of the previous embodiment. However, the alignment feature has been modified. In particular, mount 109 generally includes fastener 110, bevel 112, a support surface 114 and a fastener portion 116.

The alignment feature has been modified to reduce the constraints placed on weight member 102 relative to mount 109 by the interaction between the alignment feature and weight member 102. Namely, the alignment feature is configured to control only lateral movement of weight member 102 relative to mount 109 and so that the construction of the alignment features is simplified. Mount 109 includes an alignment feature in the form of tab 118. Tab 118 is constructed as a straight rib that extends aft-ward from bevel 112 toward fastener portion 116, and outward from support surface 114. Tab 118 includes generally parallel sidewalls so that the width of tab 118 remains approximately constant over the length of tab 118.

Weight member 102 includes an angled abutment surface 120, a fastener engagement feature 122, and an alignment feature in the form of slot 124. Slot 124 engages tab 118 when weight member 102 is installed on mount 109 and is dimensioned so that its width closely matches the width of tab 118. As a result, the engagement of slot 124 and tab 118 limits lateral movement of weight member 102 relative to the remainder of club head 100. Angled abutment surface 120 is a surface that complements the shape of bevel 112 (i.e., the angled abutment surface of bevel 112) of mount 109 and that abuts bevel 112 when weight member 102 is installed on mount 109. Similar to previous embodiments, bevel 112 and abutment surface 120 are oriented so that as weight member 102 is forced into abutment with bevel 112, by the tightening of fastener 110, weight member 102 is forced against sole 104 in mount 109.

Figure 47:
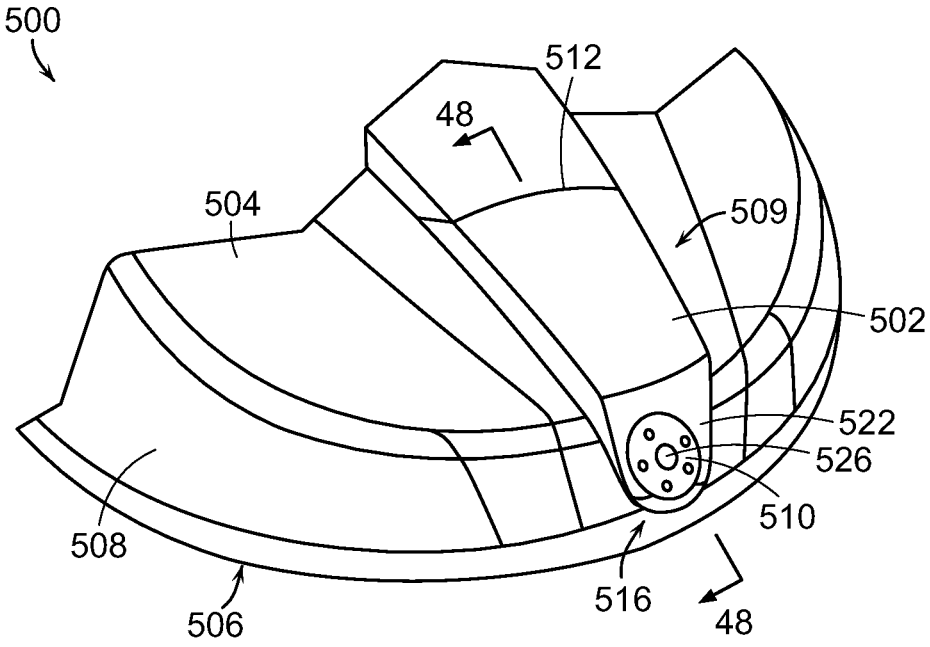
FIG. 47 is a perspective view of an aft portion of another embodiment of a golf club head including a removable weight member of the present invention.
Figure 48:
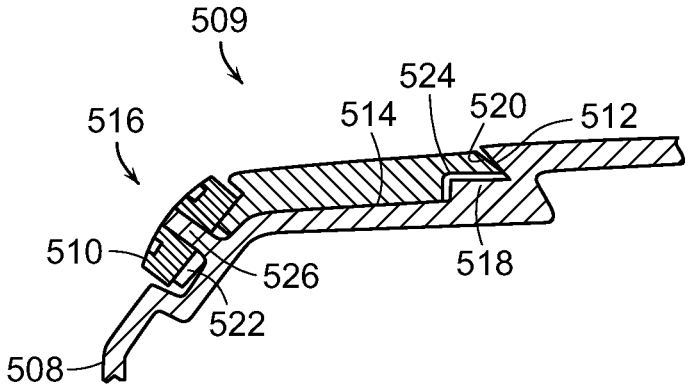
FIG. 48 is a cross-sectional view of a portion of the golf club head and removable weight member of FIG. 47.
Figure 49:
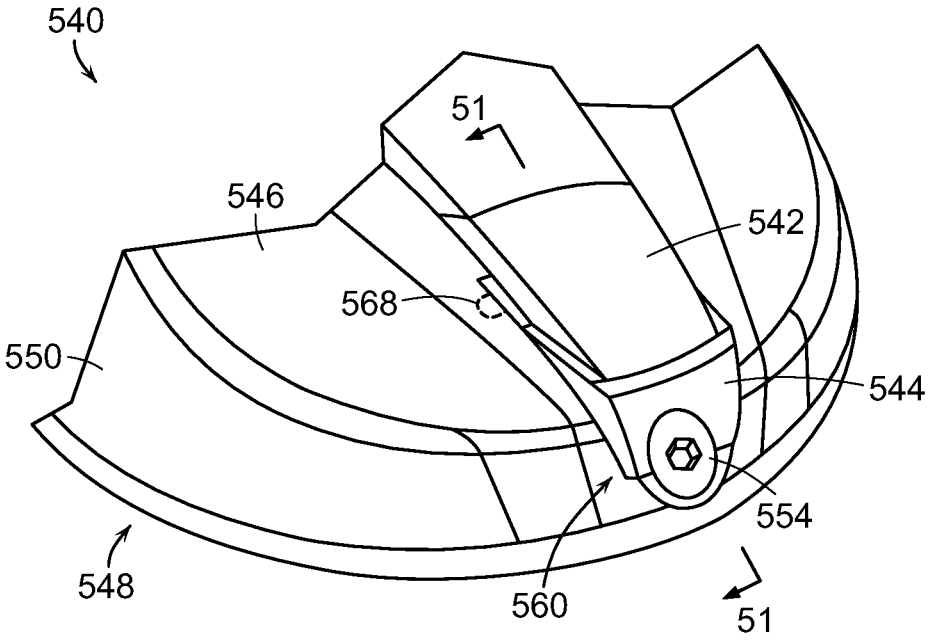
FIG. 49 is a perspective view of an aft portion of another embodiment of a golf club head including a removable weight member.
Figure 50:
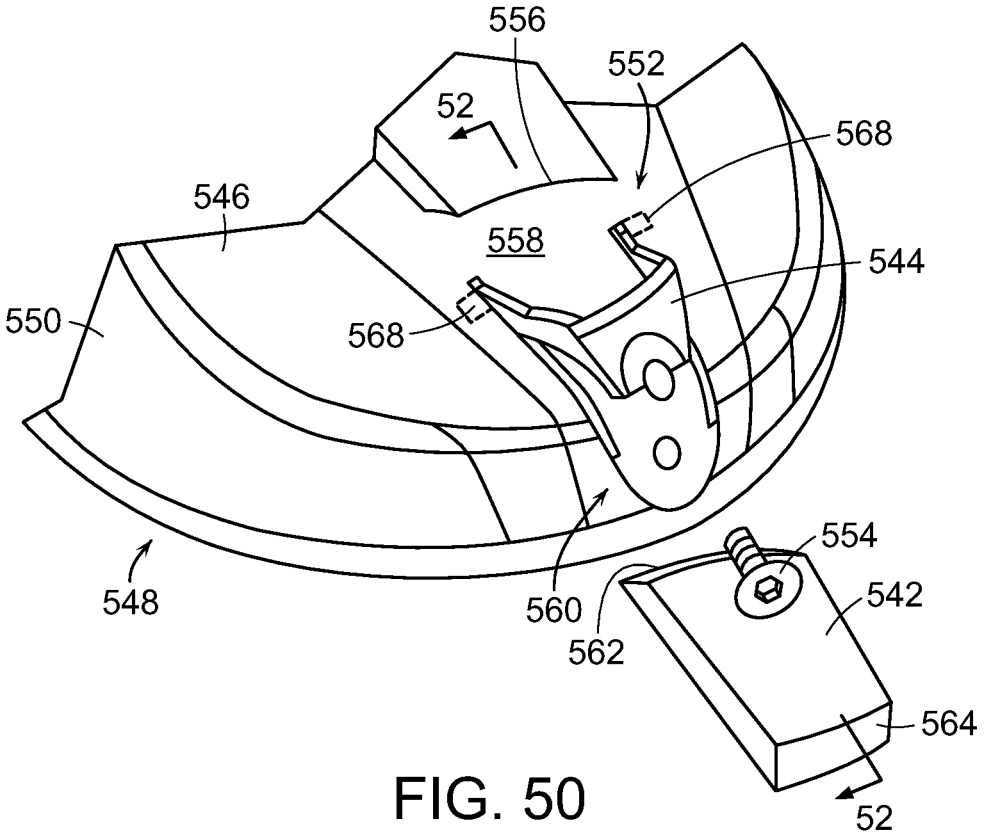
FIG. 50 is another perspective view of the aft portion of the golf club head of FIG. 49 without the removable weight member.
Figure 51:
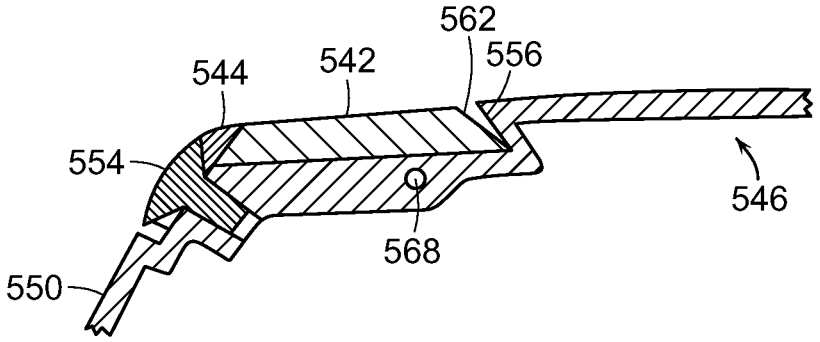
FIG. 51 is a cross-sectional view of a portion of the golf club head and removable weight member of FIG. 49.
Figure 52:
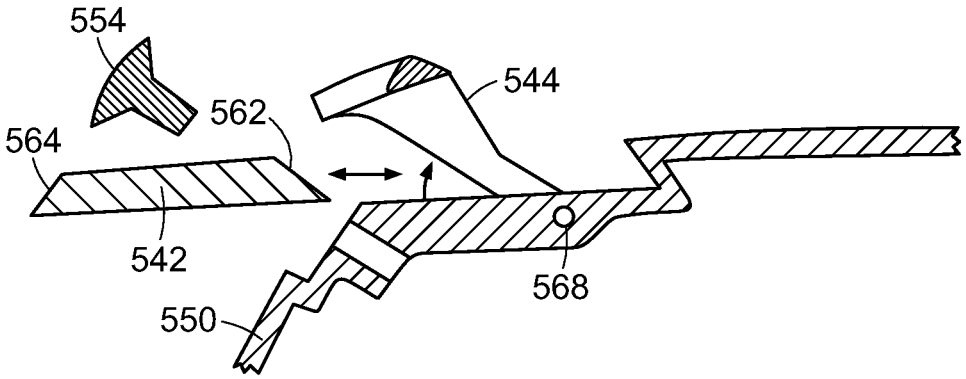
FIG. 52 is a cross-sectional view of a portion of the golf club head and removable weight member of FIG. 50.
Figure 53:
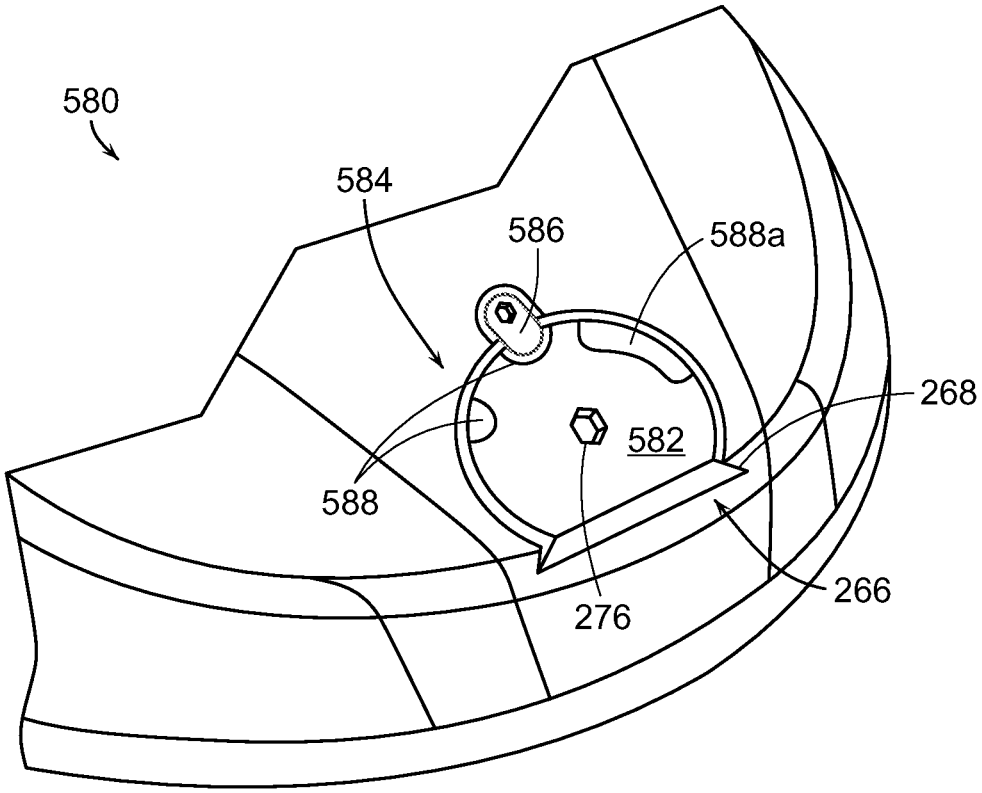
FIG. 53 is a perspective view of an aft portion of another embodiment of a golf club head including a removable weight member.

In a similar embodiment, illustrated in FIGS. 47 and 48, a golf club head 500 includes a sole 504, a crown 506, a hitting face, a skirt 508, a hosel, and a weight member 502. Sole 504 includes a weight mount 509, which is configured to couple weight member 502 and sole 504. Mount 509 generally includes a fastener 510, a bevel 512, a support surface 514 and a fastener portion 516.

Mount 509 includes an alignment feature in the form of tab 518 that interacts with weight member 502. Tab 518 is constructed as a rib with generally parallel lateral sides that extends aft-ward from bevel 512 toward fastener portion 516 and outward from support surface 514.

Weight member 502 includes an angled abutment surface 520 and a fastener engagement feature 522. Weight member 502 includes an alignment feature in the form of slot 524 that receives tab 518 when weight member 502 is installed on mount 509. Slot 524 is dimensioned so that as it receives tab 518 the side surfaces of the tab and slot are in close proximity to each other and preferably slide against each other to limit relative lateral movement between weight member 502 and the remainder of club head 500 while still allowing angled abutment surface 520 to slide along bevel 512. The height from support surface of tab 518 and slot 524 are selected so that clearance is provided between the tab and the weight member and the length from bevel 512 of tab 518 and slot 524 are selected so that clearance is provided between the aftward end of tab 518 and slot 524. As a result of those clearances, the interaction of tab 518 and slot do not limit the interaction between angled abutment surface 520 and bevel 512.

Angled abutment surface 520 is a surface that complements the shape of bevel 512 of mount 509 and that abuts bevel 512 when weight member 502 is installed on mount 509. Bevel 512 and abutment surface 520 are oriented so that as weight member 502 is forced into abutment with bevel 512 by the tightening of fastener 510, the abutment forces weight member 502 against sole 504.

Slot 524 is defined by weight member 502 and extends through a portion of angled abutment surface 520. In the present embodiment, the height of slot 524 is less than the thickness of weight member 502 so that it does not extend through the outer surface of weight member 502. As a result, and as shown in FIG. 47, neither slot 524 nor tab 518 are visible when weight member 502 is installed in club head 500.

A portion of sole 504 that extends between bevel 512 and fastener portion 516 forms support surface 514. Support surface 514 is shaped to abut the underside of weight member 502 when the weight member is installed in mount 509. Fastener portion 516 includes a fastener post 526 that is received by fastener 510. In the present embodiment, fastener 510 is a threaded nut that receives a threaded portion of fastener post 526, rather than a threaded bolt like previous embodiments, to illustrate an alternative fastener that may also be substituted in other embodiments. As fastener 510 is tightened on fastener post 526 and against weight member 502, weight member 502 is forced to translate toward bevel 512 and into the undercut formed by bevel 512.

Figure 13:
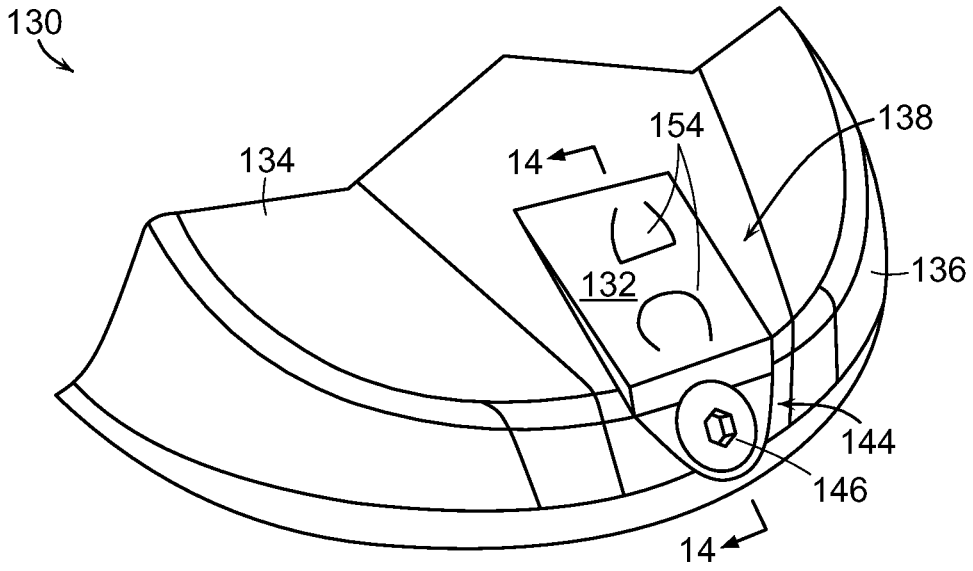
FIG. 13 is a perspective view of an aft portion of another embodiment of a golf club head including a removable weight member.
Figure 14:
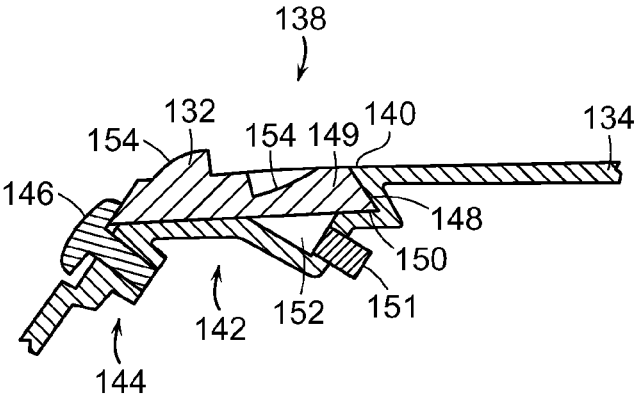
FIG. 14 is a cross-sectional view of the golf club head and removable weight member of FIG. 13.
Figure 15:
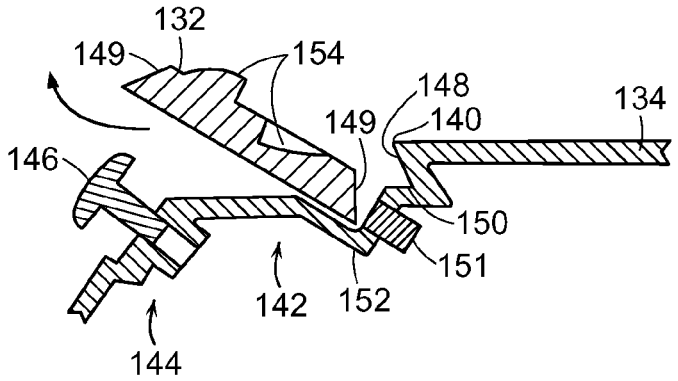
FIG. 15 is another cross-sectional view of the golf club head and removable weight member of FIG. 13.

Referring now to FIGS. 13-15, another embodiment of a golf club head 130 with a weight member 132 is illustrated. The portion of golf club head 130 that is shown includes a sole 134 and a skirt 136. Weight member 132 is installed in a weight mount 138 that extends across a portion of sole 134 and a portion of skirt 136.

Mount 138 includes a bevel 140, a support surface 142, a fastener portion 144 and a fastener 146. Bevel 140 is disposed at an end of mount 138 and includes an angled surface 148 that forcibly abuts an angled engagement surface 149, which is may be a planar surface, of weight member 132 when the weight member is fully installed on mount 138. In the illustrated embodiment, weight member 132 includes angled engagement surfaces 149 at opposite ends so that weight member 132 may be installed in one of two orientations rotated 180° relative to each other.

In the present embodiment, mount 138 includes a contoured support surface 142 to simplify the removal of weight member 132 from mount 138. The contoured support surface 142 generally includes an abutment portion 150 that is located adjacent bevel 140, and a recessed portion 152. Abutment portion 150 provides a surface that limits the translation of weight member 132 toward the remainder of the golf club head when one of the angled abutment surfaces 149 is forced against bevel 148.

Recessed portion 152 permits weight member 132 to be tilted relative to mount 138 during its insertion and removal, as shown in FIG. 15. In particular, the ability to tilt weight member 132 assists in its removal from mount 138 and so that fastener 146 need not be fully removed during insertion and removal of weight member 132. Recessed portion 152 is disposed between abutment portion 150 and fastener portion 144 and extends toward the interior of club head 130 relative to abutment portion 150. Recessed portion 152 is sized and located in mount 138 so that weight member 132 covers recessed portion 152 when it is installed in mount 138. Recessed portion 152 may be stepped, curved or tapered to provide any desired amount of movement of weight member 138 and the desired amount of clearance relative to fastener. Recessed portion may also be configured to receive an optional secondary weight member 151. It should be appreciated, however, that an optional secondary weight member may be included in any of the embodiments described and shown herein. For example, any of the other embodiments may include a secondary weight member mounted in the support surface of the mount.

All of the weight members of the present invention are preferably removable from the golf club head without requiring the full disengagement of the fastener from the fastener portion of the mount. For example, in the present embodiment, fastener 146 is partially backed out from fastener portion 144, which provides clearance for weight member 132 to be slid toward fastener 146 within mount 138, tilted, and then removed from mount 138. The shape and dimensions of recessed portion 152 are selected so that weight member 132 may be removed after backing fastener 146 out by a predetermined amount. In an embodiment, recessed portion 152 is dimensioned and shaped so that weight member 132 may be removed after backing the fastener out by less than 0.250 inch, more preferably by less than 0.125 inch.

One or more grip features 154 are also included on weight member 132. Grip feature 154 provides a recessed, or raised, portion on weight member 132 that allows a user to grip the weight member, especially during removal. Grip feature 154 is preferably sized and shaped to engage with a user's fingertip, or another blunt tool to drag and tilt the weight member relative to the remainder of club head 130.

Figure 16:
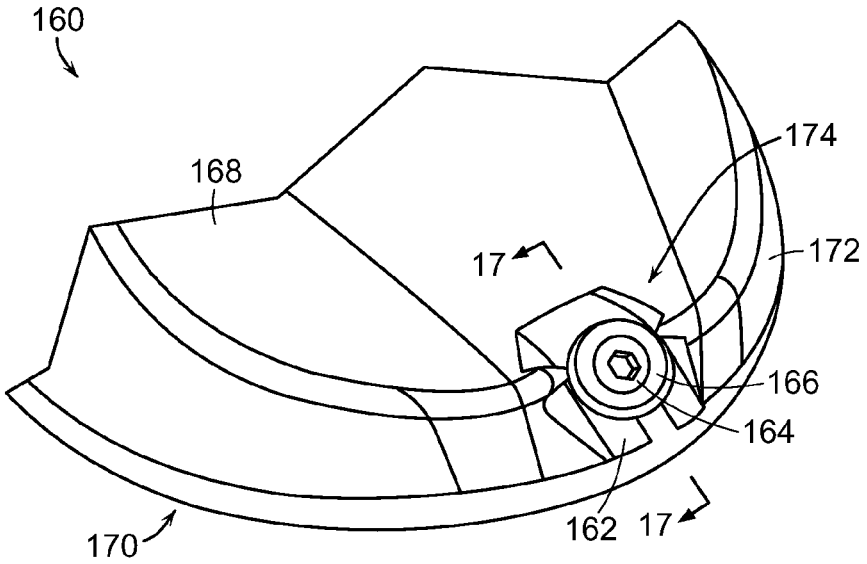
FIG. 16 is a perspective view of an aft portion of another embodiment of a golf club head including a removable weight member.
Figure 17:
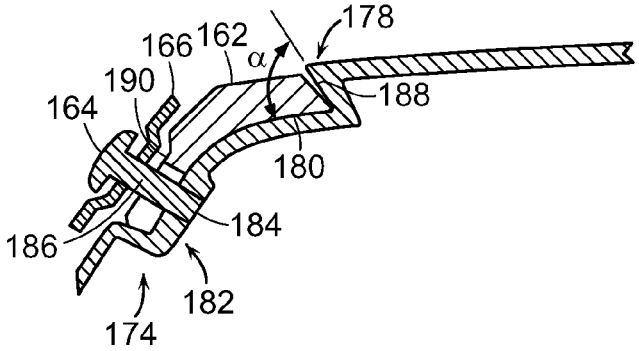
FIG. 17 is a cross-sectional view of the golf club head and removable weight member of FIG. 16.

In another embodiment, shown in FIGS. 16 and 17, a golf club head 160 includes a weight member 162 that is retained on club head 160 using a fastener 164 and a retainer 166. Similar to the previous embodiments, golf club head 160 includes a sole 168, a crown 170, a hitting face, a skirt 172, a hosel, and weight member 162. Sole 168 includes a weight mount 174, which is configured to couple weight member 162 and sole 168.

Mount 174 generally includes fastener 164, a bevel 178, a support surface 180 and a fastener portion 182 and is recessed into a portion of club head 160 that extends from sole 168 to skirt 172. A portion of the club head body defines bevel 178 that extends outward from support surface 180 at a location that is spaced from fastener 164. Bevel 178 is angled relative to a portion support surface 180 immediately adjacent bevel 178 by a bevel angle $\alpha$. Preferably, bevel angle $\alpha$ is acute relative to support surface 180.

Support surface 180 extends between bevel 178 and fastener portion 182 and is a generally curved surface that abuts the underside of weight member 162 when it is installed in mount 164. Fastener portion 182 includes a threaded bore 184 that receives a threaded shank 186 of fastener 164.

Weight member 162 includes an angled abutment surface 188 and a retainer engagement feature 190. The outer perimeter of weight member 162 acts as an alignment feature and complements the size and shape of the recessed mount 174. Angled abutment surface 188 is a surface that complements the shape of bevel 178 of mount 174 and that abuts bevel 178 when weight member 162 is installed on mount 174. Bevel 178 and abutment surface 188 are oriented so that as weight member 162 is forced into abutment with bevel 178 by the tightening of fastener 164 and retainer 166. The abutment of the angled surfaces forces weight member 162 to be drawn against support surface 180 in mount 174.

Figure 18:
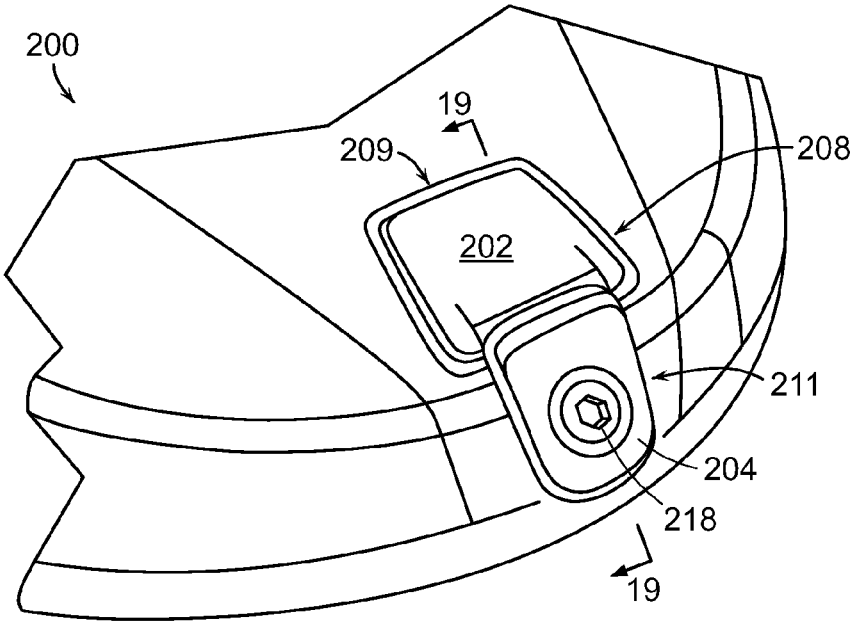
FIG. 18 is a perspective view of an aft portion of another embodiment of a golf club head including a removable weight member.
Figure 19:
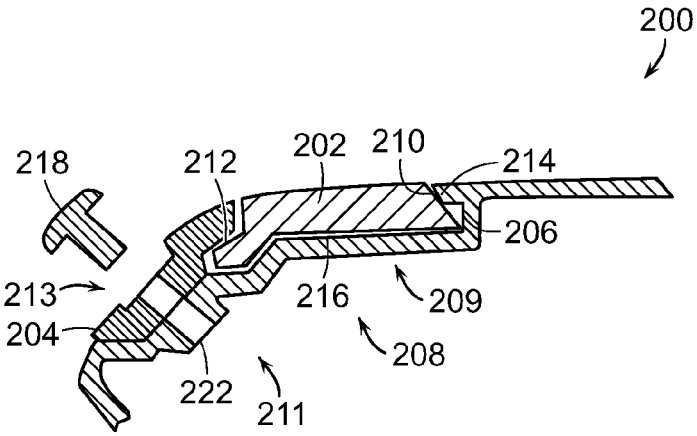
FIG. 19 is a cross-sectional view of the golf club head and removable weight member of FIG. 18.

Another embodiment of a golf club head 200 with a weight member 202 is illustrated in FIGS. 18 and 19. Similar to the previous embodiment, weight member 202 is retained on club head 200 by a retainer 204. Retainer 204 is a component that is separate from weight member 202 and forces weight member 202 to abut an undercut 206 included in a weight mount 208. Undercut 206 is illustrated with an alternative construction, but it should be appreciated that the undercut may alternatively be formed by a bevel. Mount 208 is configured so that as retainer 204 is drawn into mount 208 by a fastener 218 the retainer 204 abutment with weight member 202 forces the weight member toward undercut 206

Mount 208 includes a weight portion 209 and a retainer portion 211. Weight portion 209 receives weight member 202 and includes undercut 206. Retainer portion 211 receives retainer 204 and includes a fastener engagement feature 213 that engages fastener 218 so that retainer 204 is removably coupled to club head 200.

Weight member 202 has a low profile configuration similar to previous embodiments. Weight member 202 includes an angled abutment surface 210 and a retainer engagement feature 212, which may be a flange, as shown. Angled abutment surface 210 engages an abutment edge 214 of mount 208 that is adjacent undercut 206, and undercut 206 is dimensioned so that as angled abutment surface 210 is forced against abutment edge 214, clearance is provided for a portion of weight member 202 to enter undercut 206 while weight member 202 is forced tighter against a support surface 216 of mount 208.

Retainer 204 also has a low profile configuration and is received in a portion of mount 208. Retainer 204 extends toward weight member 202 so that an abutment flange 220 of retainer 204 abuts a portion of weight member 202. Retainer 204 also includes a fastener bore 222 that receives fastener 218 so that fastener 218 extends through a portion of retainer 214 and engages fastener engagement feature 213, which may be a threaded bore, as shown.

In another embodiment, illustrated in FIGS. 49-52, a golf club head 540 includes a weight member 542 that is retained on club head 540 by a retainer 544. Golf club head 540 includes a sole 546, a crown 548, a hitting face, a skirt 550, a hosel, and weight member 542. Sole 546 includes a weight mount 552, which is configured to couple weight member 542 and sole 546. Mount 552 generally includes a fastener 554, a bevel 556, a support surface 558 and a fastener portion 560.

Retainer 544 is a component that is separate from weight member 542 that is pivotally mounted to sole 546 of golf club head 540 at pivots 568. Retainer 544 forces weight member 542 to abut an undercut formed by bevel 556. Mount 552 is configured so that tightening fastener 554 forces retainer 544 toward sole 546 and against an aft portion of weight member 542. The interaction between retainer 544 and weight member 542 forces weight member 542 forward toward and into abutment with bevel 556.

Weight member 542 has a low profile configuration similar to previous embodiments. Weight member 542 includes an angled abutment surface 562 and a retainer engagement feature 564, which may be an angled surface, as shown. Angled abutment surface 562 engages bevel 556 when retainer 544 is forced against weight member 542. Additionally, and as shown, retainer engagement feature 564 may have the same shape and size as angled abutment surface 562 so that weight member 542 may be installed in one of two orientations rotated 180° from each other. Preferably, in such an embodiment more mass is concentrated toward one of angled abutment surface 562 and retainer engagement feature 564 than the other so that the two orientations provide different mass distribution.

Retainer 544 is pivotally connected to sole 546 adjacent to support surface 558 so that it may be pivoted between a first position and a second position. In the first position, shown in FIGS. 49 and 51, retainer 544 is positioned so that weight member 542 is interposed between retainer 544 and bevel 556. In that position, an abutment surface 566 of retainer 544 abuts the angled surface that forms the retainer engagement feature 564 and that abutment forces weight member 542 laterally toward bevel 556. In the second position, shown in FIGS. 50 and 52, retainer 544 is tilted away from support surface 558 and provides clearance for weight member 542 to be translated away from bevel 556 and removed from weight mount 552.

Figure 20:
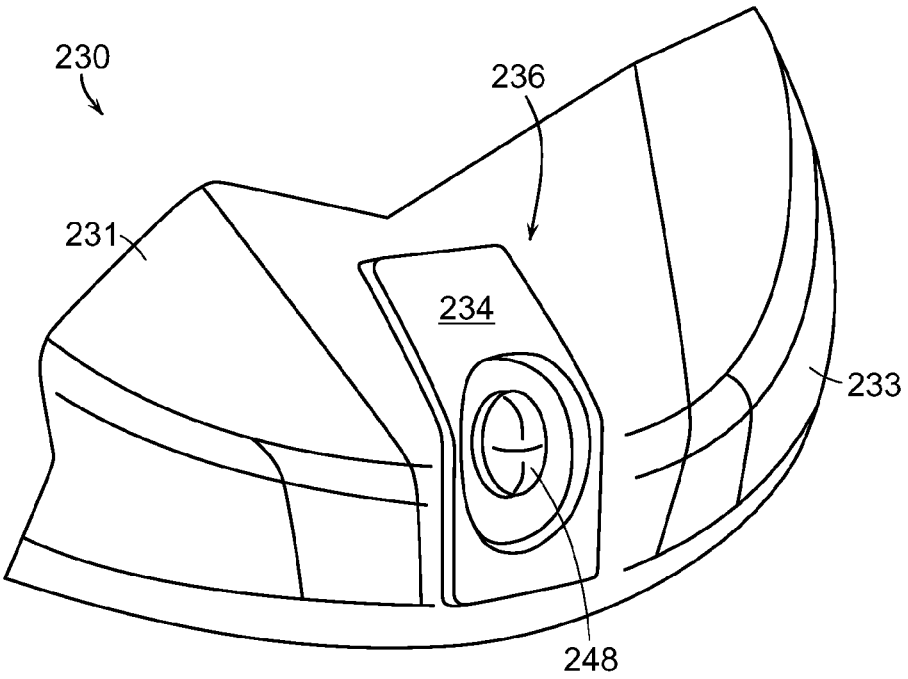
FIG. 20 is a perspective view of an aft portion of another embodiment of a golf club head including a removable weight member.
Figure 21:
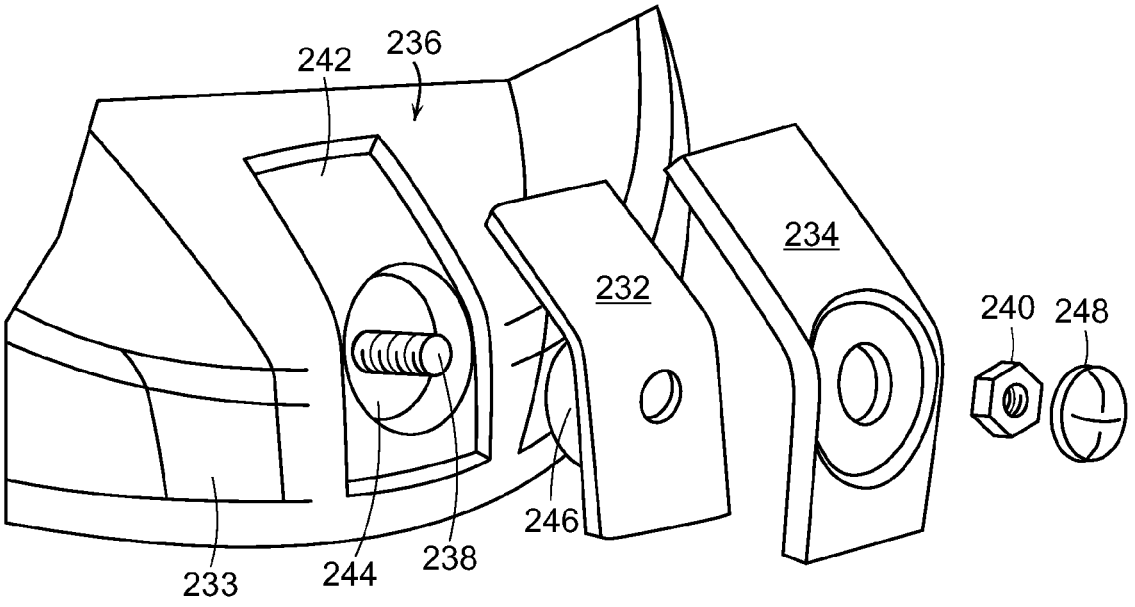
FIG. 21 is an exploded view of the golf club head and removable weight member of FIG. 20.
Figure 22:
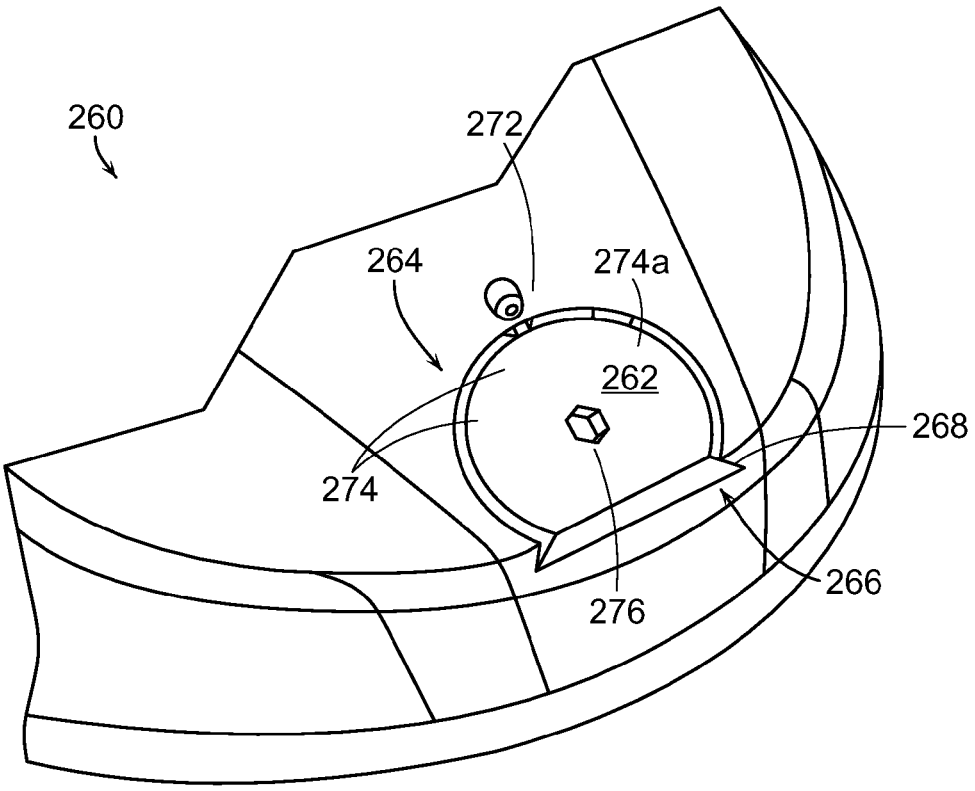
FIG. 22 is a perspective view of an aft portion of another embodiment of a golf club head including a removable weight member.

In another embodiment, shown in FIGS. 20 and 21, golf club head 230 includes a weight member 232 that is coupled to the club head by a retainer 234. Retainer 234 also provides a cover for weight member 232 so that the shape and appearance of the outer surface of golf club head 230 remains the same while one of a plurality of weight members 232 having different masses or configurations may be incorporated.

Additionally, an alternative fastener configuration is included in the present embodiment. In particular, a weight mount 236 includes a stud 238 that extends through weight member 232 and retainer 234, and engages a nut 240. Nut 240 is removably attached to stud 238 so that it forces retainer 234 against weight member 232 and into mount 236.

Mount 236 is shaped to complement the shape of weight member 232 and is generally recessed into a portion of a sole 231 and a skirt 233 of golf club head 230. Mount 236 includes a primary recess 242 and a secondary recess 244. Primary recess 242 is shaped to complement the perimeter shape of weight member 232 and retainer 234 so that both fit inside mount 236. Secondary recess 244 is shaped and sized to receive an optional projection 246 included on weight member 232. The size and shape of projection 246 is selected based on the overall desired mass of weight member 232. The location of weight member 232 is determined by the interaction between weight member 232 and primary recess 242. As a result, projection 246 may either fully or partially extend into secondary recess 244.

An optional cap 248 is also included in the present embodiment. Cap 248 provides a cover for nut 240. By covering nut 240, cap 248 provides a secondary locking feature to nut 240 and/or protection to nut 240.

Referring to FIGS. 22-25, a golf club head 260 includes a low profile weight member 262. In the present embodiment, weight member 262 is shaped so that it must be in a predetermined orientation relative to a mount 264 for it to be inserted into mount 264, then the weight member trapped in the mount by rotating the weight member relative to the mount. In particular, a first width W1 of weight member 262 is less than a second width W2 of weight member 262. Mount 264 includes an opening 266 that has a width W3 that is greater than first width W1 of weight member 262, but less than second width W2. As a result, weight member 262 may be slid into mount 264 only in a predetermined orientation corresponding to the first width W1 extending across opening 266. Then, by rotating weight member 262 within mount 264 the weight member becomes captured in mount 264. A tool engagement feature 276 may be included on weight member 262 so that weight member 262 may be rotated using a tool that is inserted into tool engagement feature 276, such as a hex key or screw driver.

Mount 264 also includes an undercut 268 that extends around at least a portion of the perimeter of mount 264. In the present embodiment, undercut 268 is a bevel that receives an angled engagement surface 270 of weight member 262. The interaction between undercut 268 and engagement surface 270 limits translation of the weight member 262 relative to mount 264 outward and away from club head 260 while allowing weight member 262 to rotate within mount 264 so that weight member 262 may be installed and removed from mount 264. Preferably, undercut 268 and engagement surface 270 are located on weight mount 264 and weight member 262 so that when weight member 262 is installed the undercut and engagement surface engage adjacent opening 266. More preferably, undercut 268 and engagement surface 270 extend around a majority of the circumferences of mount 264 and weight member 262.

An anti-rotation and clamping feature, such as screw 272 is also included in mount 264 that engages a recess 274 so that the rotation of weight member 262 in mount 264 may be selectively prevented, or limited to a predetermined amount. The anti-rotation feature is constructed so that when screw 272 engages recess 274 of weight member 262, it locks weight member 262 into a particular orientation relative to mount 264 that is different than the orientation that allows weight member 262 to be removed from mount 264. Additionally, screw 272 is oriented so that it urges weight member 262 toward a side of mount 264 so that angled engagement surface 270 abuts a portion of undercut 268. The orientation of screw 272 illustrated in FIGS. 22-24 results in screw 272 forcing weight member 262 toward opening 266 so that the portions of undercut 268 adjacent opening 266 abut corresponding portions of engagement surface 270.

Screw 272 may lock weight member 262 into one of a plurality of orientations by selectively engaging one of a plurality of recesses 274, or it may limit the rotation of weight member 262 relative to mount 264 to a predetermined range of angular rotation by selectively an extended recess 274*a* that extends along a portion of the perimeter of weight member 262.

Figure 23:
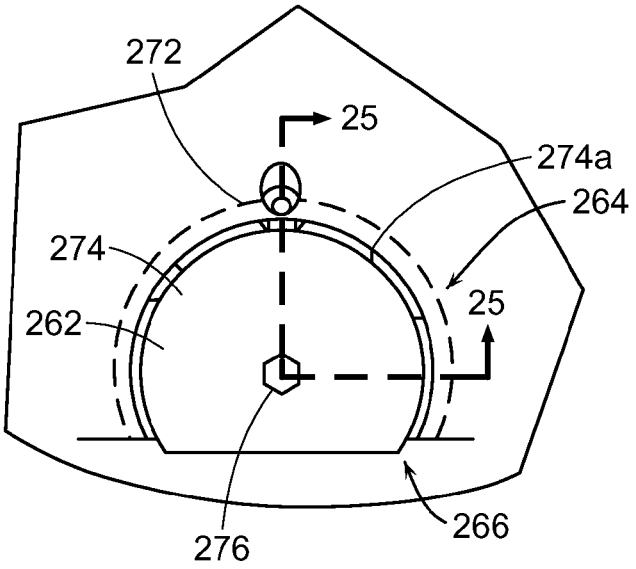
FIG. 23 is a plan view of the portion of the golf club head and outer side of the removable weight member of FIG. 22.
Figure 24:
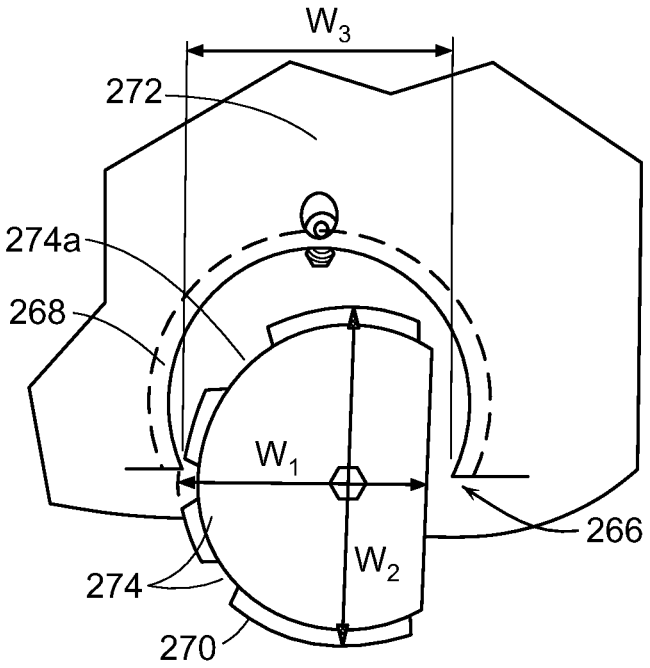
FIG. 24 is another plan view of the portion of the golf club head and outer side of the removable weight member of FIG. 22.
Figure 25:
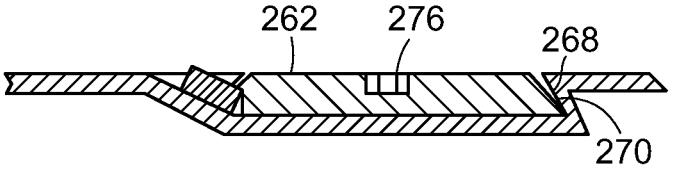
FIG. 25 is a cross-sectional view of the portion of the golf club head and removable weight member of FIG. 22.
Figure 26:
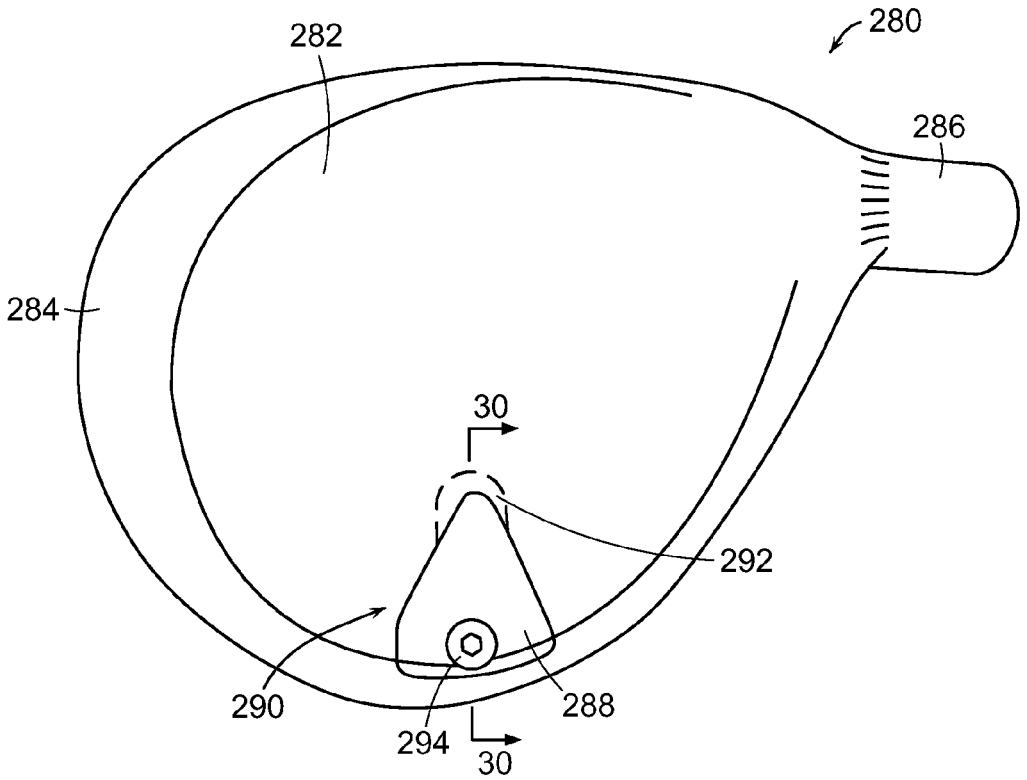
FIG. 26 is a plan view of another golf club head and removable weight member.
Figure 27:
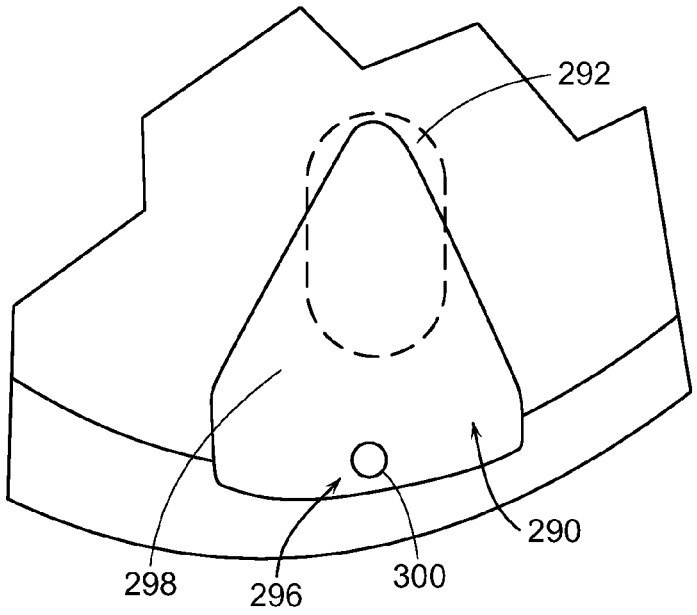
FIG. 27 is a plan view of a sole, aft portion of the golf club head of FIG. 26 without the removable weight member.
Figure 28:
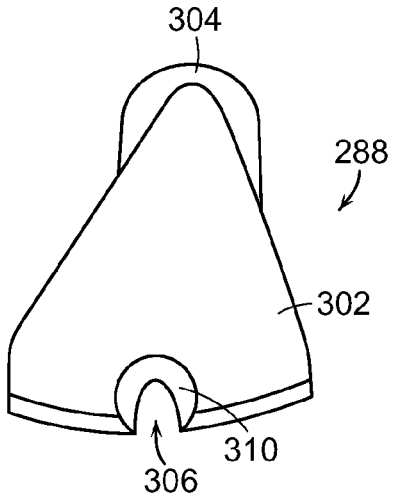
FIG. 28 is a plan view of an outer side of the removable weight member of FIG. 26.
Figure 29:
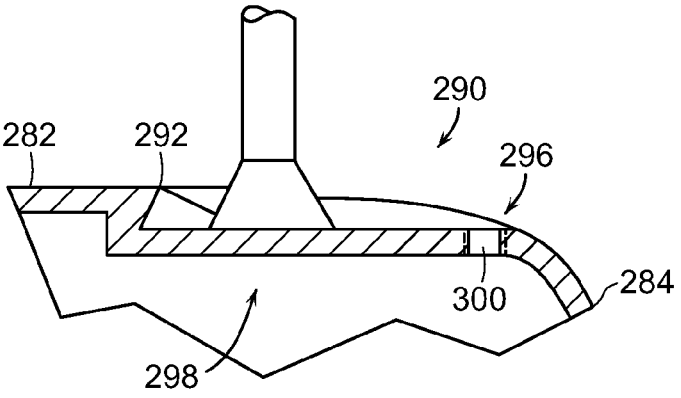
FIG. 29 is a cross-sectional view of a portion of the golf club head of FIG. 26.
Figure 30:
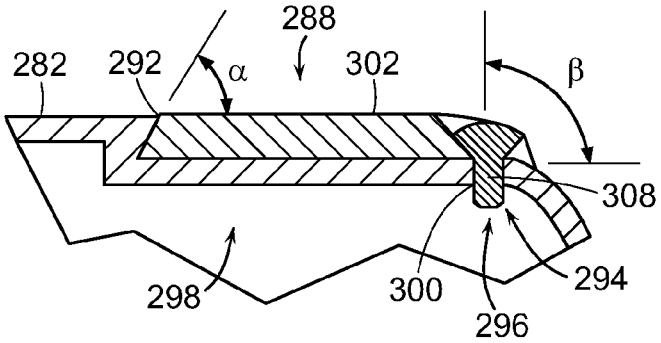
FIG. 30 is a cross-sectional view of a portion of the golf club head, and the removable weight member, of FIG. 26.
Figure 31:
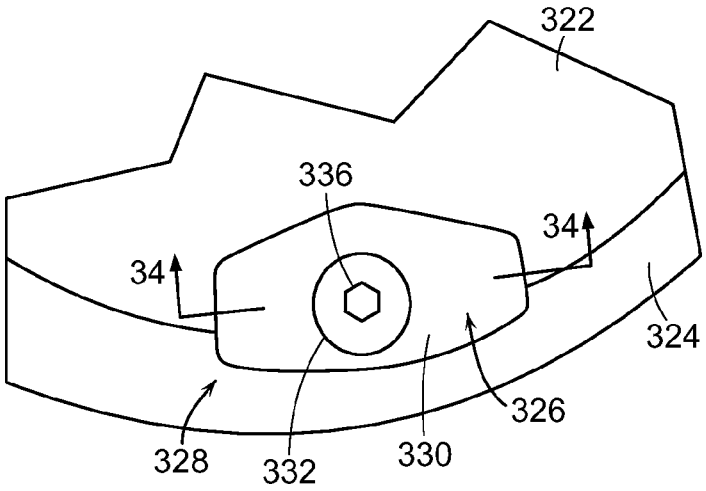
FIG. 31 is a plan view of an aft portion of another golf club head and an outer side of removable weight member.
Figure 32:
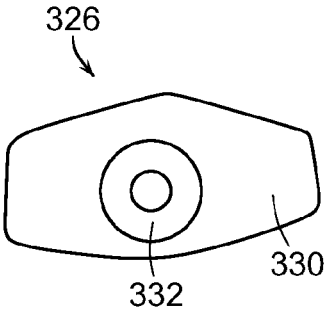
FIG. 32 is a plan view of an outer side of the removable weight member of FIG. 31.

Referring to FIGS. 23 and 24, the orientations of weight member 262 for installation and removal will be described. Weight member 262 is illustrated fully installed in mount 264 in FIG. 23. Weight member 262 is inserted into mount 264 by orienting weight member 262 so that the portion of weight member 262 having width W1 is oriented across opening 266, as shown in FIG. 24. Then, weight member 262 is slid into mount 264, relative to club head 260, until an end of weight member 262 is adjacent screw 272 with screw 272 being at least partially backed out of mount 264. Weight member 262 is rotated to a fully installed orientation in which it is oriented so that screw 272 is aligned with a recess 274. Screw 272 is then tightened so that it is positioned partially within recess 274 and further rotation of weight member 262 within, and relative to, mount 264 is prevented.

The removal of weight member 262 is accomplished by reversing the installation procedure described above. In particular, screw 272 is disengaged from recess 274 so that weight member 262 is free to rotate within mount 264. Next, weight member 262 is rotated so that a portion of weight member 262 that is narrower than opening 266 (e.g., a portion with width W1) is aligned with opening 266. Finally, weight member 262 is slid through opening 266 and removed from mount 264.

In another embodiment, illustrated in FIGS. 53-56, a golf club head 580 includes a weight member 582 that is inserted and removed from a weight mount 584 similar to the weight member of the previous embodiment. As a result, many of the features of the golf club head are identical and will be designated by the same numbers used in the previous embodiment and will not be further described.

Weight member 582 has a low profile and is shaped so that it must be in a predetermined orientation relative to a mount 584 for it to be inserted into mount 584, then the weight member trapped in the mount by rotating the weight member relative to the mount. In particular, a first width W1 of weight member 582 is less than a second width W2 of weight member 582. Mount 584 includes an opening 266 that has a width W3 that is greater than first width W1 of weight member 582, but less than second width W2. As a result, weight member 582 may be slid into mount 584 only in a predetermined orientation corresponding to the first width W1 extending across opening 266. Then, by rotating weight member 582 within mount 584 the weight member becomes captured in mount 584.

Mount 584 includes an undercut 268 and an anti-rotation and clamping feature. Undercut 268 receives an angled engagement surface 270 of weight member 582. An anti-rotation and clamping feature, such as tab 586 is also included in mount 584 that engages a recess 588 so that the rotation of weight member 582 in mount 584 may be selectively prevented, or limited to a predetermined amount. Tab 586 is coupled to the sole of the club head adjacent weight mount 584 by a fastener so that tab can be tightened into an adjacent recess 588 of weight member 582. The anti-rotation feature is constructed so that when tab 586 engages recess 588 of weight member 582, it locks weight member 582 into a particular orientation relative to mount 584 that is different than the orientation that allows weight member 582 to be removed from mount 584. Tab 586 may lock weight member 582 into one of a plurality of orientations by selectively engaging one of a plurality of recesses 588, or it may limit the rotation of weight member 582 relative to mount 584 to a predetermined range of angular rotation by selectively an extended recess 588*a* that extends along a portion of the perimeter of weight member 582.

Figure 54:
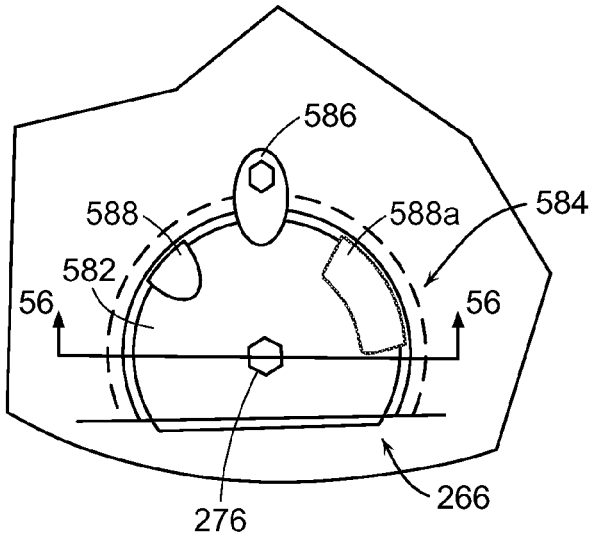
FIG. 54 is a plan view of the portion of the golf club head and outer side of the removable weight member of FIG. 53.
Figure 55:
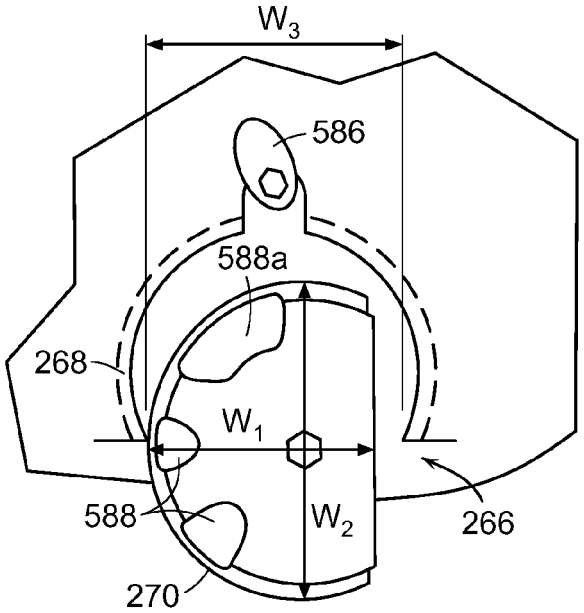
FIG. 55 is another plan view of the portion of the golf club head and outer side of the removable weight member of FIG. 53.
Figure 56:
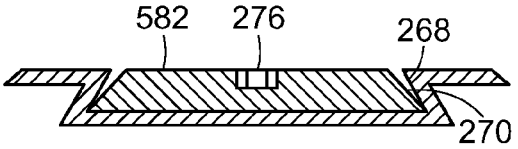
FIG. 56 is a cross-sectional view of the portion of the golf club head and removable weight member of FIG. 53.

FIGS. 54 and 55 illustrate the orientations of weight member 582 for installation and removal. In particular, weight member 582 is illustrated fully installed in mount 584 in FIG. 54. Weight member 582 is inserted into mount 584 by orienting weight member 582 so that the portion of weight member 582 having width W1 is oriented across opening 266, as shown in FIG. 55. Then, weight member 582 is slid into mount 584, relative to club head 580, until an end of weight member 582 is adjacent tab 586 with tab 586 being rotated away from weight member 582. Weight member 582 is rotated to a fully installed orientation in which it is oriented so that tab 586 is aligned with a recess 588. Tab 586 is then tightened so that it is positioned partially within recess 588 and further rotation of weight member 582 within, and relative to, mount 584 is prevented.

The removal of weight member 582 is accomplished by reversing the installation procedure described above. In particular, tab 586 is disengaged from recess 588 so that weight member 582 is free to rotate within mount 584. Next, weight member 582 is rotated so that a portion of weight member 582 that is narrower than opening 266 (e.g., a portion with width W1) is aligned with opening 266 and weight member 582 is slid through opening 266 and removed from mount 584.

Another embodiment will be described with reference to FIGS. 26-30. In particular, a golf club head 280 includes a sole 282, a crown (not shown), a hitting face (not shown), a skirt 284, a hosel 286, and a weight member 288. Sole 282 includes a weight mount 290, which is configured to couple weight member 288 to sole 282. In the present embodiment, mount 290 is a recessed portion of sole 282 that is shaped to complement the shape of weight member 288. For example, weight member 288 is generally trapezoidal in plan shape and weight mount 290 includes a generally trapezoidally-shaped recess.

Mount 290 is configured to clamp weight member 288 between a conical bevel 292 and a fastener 294. The conical bevel 292 provides lateral, heel-toe positioning in addition to fore-aft positioning of weight member 288 relative to mount 290. Mount 290 is configured so that when weight member 288 is located on mount 290, and fastener 294 is tightened, the interaction between fastener 294 and weight member 288 results in forces that translate weight member 288 laterally against bevel 292. The interaction between weight member 288 and bevel 292 causes at least a portion of weight member 288 to be drawn tighter against a support portion 298.

In the present embodiment, mount 290 is partially recessed and extends into a portion of sole 282 and skirt 284. Mount 290 is shaped to complement the shape of weight member 288 so that it provides alignment for weight member 288. Mount 290 includes a fastener portion 296 and support portion 298. Fastener portion 296 includes a threaded bore 300 that receives a threaded shank of fastener 294. Support portion 298 is a generally planar surface that extends between fastener portion 296 and bevel 292 and provides support for weight member 288.

Bevel 292 extends from support portion 298 at a location that is spaced from fastener 294. Bevel 292 is angled relative to support portion 298 by a bevel angle $\alpha$ that is preferably acute relative to support portion 298. The conical bevel 292 also provides an efficient construction for manufacture. For example, bevel 292 may be constructed using a single pass of a dovetail-type cutter, as shown by phantom lines in FIG. 27 and in FIG. 29.

Weight member 288 has a low profile configuration and includes an angled abutment surface 304 and a fastener engagement feature 306. Angled abutment surface 304 is a surface that complements the shape of bevel 292 of mount 290 and that abuts bevel 292 when weight member 288 is installed on mount 290. Bevel 292 and abutment surface 304 are oriented so that as weight member 288 is forced into abutment with bevel 292, that abutment forces weight member 288 to be drawn tighter against sole 282 in mount 290.

Fastener 294 is configured so that it forces weight member 288 toward bevel 292 as it is tightened in club head 280. In the present embodiment, the shape of fastener 294 and the configuration of engagement between fastener 294 and weight member 288 are selected so that weight member 288 is forced into bevel 292. Fastener 294 includes a threaded shank 308 that engages a threaded bore 300 of mount 290. In the present embodiment, instead of utilizing the angle of fastener to drive weight member 288 toward bevel 292, the mating configuration of fastener with weight member 288 is utilized. Threaded bore 300 extends into fastener portion 296 of mount 290 and is oriented so that it is about normal to support portion 298. Fastener 294 includes a tapered engagement portion that abuts a tapered portion 310 of weight member 288. The angled interaction between the fastener and the weight member forces the weight member toward bevel 292 so that weight member 288 becomes captured on sole 282. Fastener 294 engages club head 280 at a coupling angle β, that has a magnitude that is about 90° and the tapered portion of the fastener provides a component of force that is directed toward bevel 28 as fastener 26 is tightened.

Bevel angle α is selected so that as weight member 288 is forced into bevel 292, weight member 288 is forced against support portion 298 and tighter against sole 282. Bevel angle α is preferably 25°-65°, and more preferably 35°-55°.

In a still further embodiment, illustrated in FIGS. 31-34, golf club head 320 includes a sole 322, a crown, a hitting face, a skirt 324, a hosel, and a weight member 326. Weight member 326 is attached to club head 320 at a weight mount 328. Weight member 326 and mount 328 are shaped and sized to complement each other and so that relative rotation is limited. For example, weight member 326 has a generally polygonal shape and mount 328 has a matching shape and is recessed into sole 322 so that when weight member 326 is installed it is prevented from rotation relative to mount 328.

Figure 33:
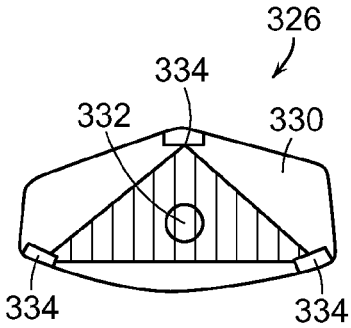
FIG. 33 is a plan view of an inner side of the removable weight member of FIG. 31.
Figure 34:
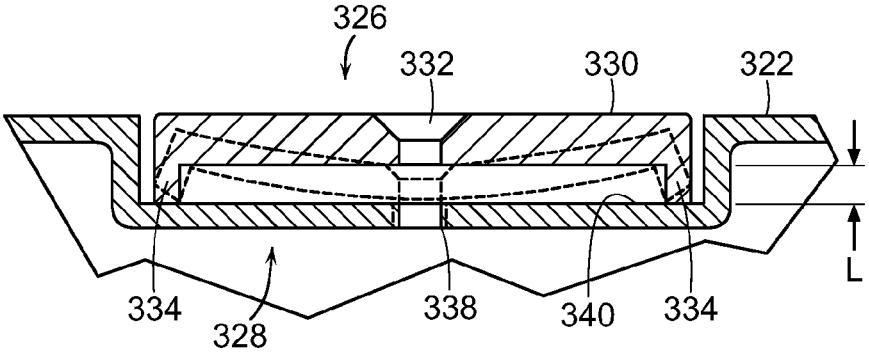
FIG. 34 is a cross-sectional view of the golf club head and removable weight member of FIG. 31.

Weight member 326 includes a weight body 330 that defines a fastener bore 332 and pads 334 that extend from a lower surface of weight body 330. Fastener bore 332 receives a fastener 336 that extends through weight body 330 and into an engagement feature included in mount 328, such as threaded bore 338. A plurality of pads 334 are disposed on weight body 330 and extend from the lower surface of body 330 by a length L. Fastener bore 332 is located within a polygonal area that is defined by a polygon drawn so that each pad 334 forms a vertex of the polygon. For example, and as illustrated in FIG. 33, weight member 326 includes three (3) pads 334 that define a triangle (illustrated by the shaded area) and fastener bore 332 is located within an area circumscribed by that triangle.

Pads 334 are included on weight member 326 so that weight member 326 is able to flex during insertion. In particular, fastener 336 extends through fastener bore 332 and engages threaded bore 338. As fastener 336 is tightened, weight member 326 is drawn into mount 328. Pads 334 contact a support surface 340 of mount 328. As fastener 336 is tightened further, it causes weight member 326 to flex (shown by dashed lines in FIG. 34), which increases the load on fastener 336 and helps to assure that fastener 336 does not loosen during impact. The height and distance between pads 334 is selected to provide the desired flex of weight member 326 and load on fastener 336. In an embodiment, the height of pads is between about 0.030 inch to about 0.125 inch. Preferably, the pads are dimensioned so that a majority of a bottom surface of the weight member is spaced from the support surface by a distance approximately equal to the pad height.

Figure 35:
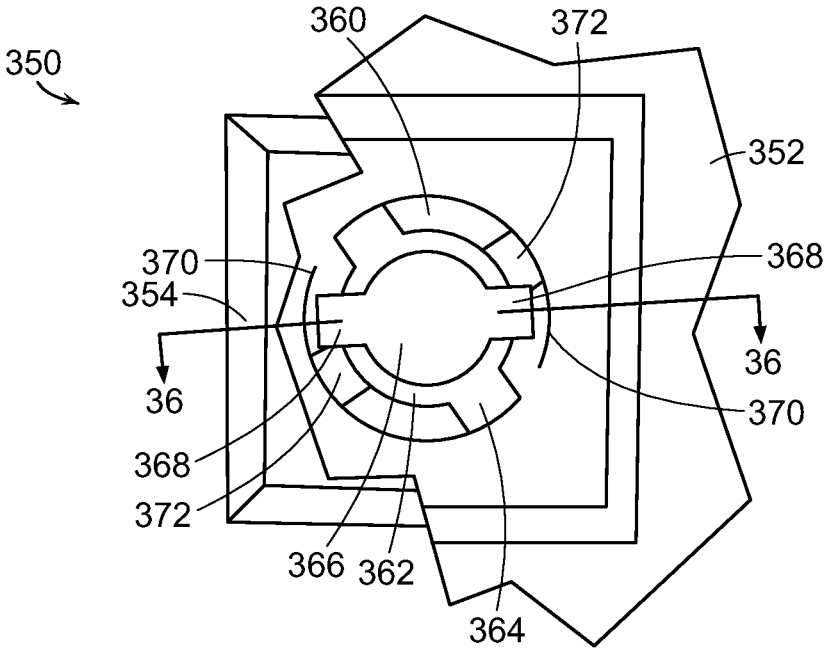
FIG. 35 is a plan view of an inner side of a portion of another golf club head an inner side of a removable weight member.
Figure 36:
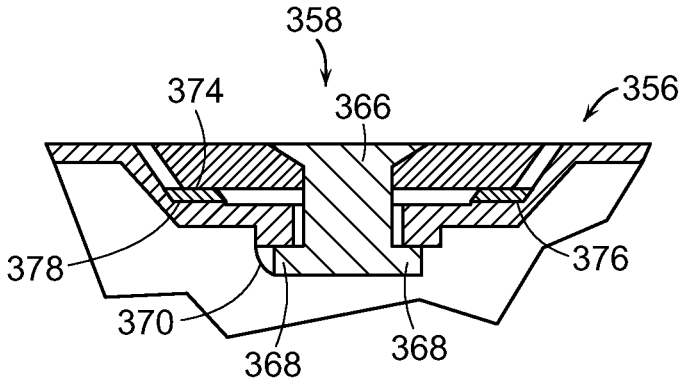
FIG. 36 is a cross-sectional view of the golf club head and removable weight member of FIG. 35.

In another embodiment, shown in FIGS. 35 and 36, a weight member 354 is coupled to a mount 356 that is located on a sole 352 of a golf club head 350. Weight member 354 is coupled to mount 356 by a fastener 358 that extends through weight member 354 and into a fastening feature 360 of mount 356. Fastener 358 and fastening feature 360 are constructed so that fastener 358 is placed in a fully locked position with less then a full turn relative to mount 356.

Fastening feature 360 includes a through-bore 362 and keyways 364 that are sized to receive a shank 366 and projections 368 on fastener 358. Fastener 358 is aligned with keyways 364 and inserted. After it is fully inserted, fastener 358 is turned so that projections 368 slide along circumferential ramps 370 and into détentes 372. In the present embodiment, détentes 372 are portions of ramps 370 that are recessed toward a support surface 374 of mount 356.

Support surface 374 includes step portions 376, which may be discrete pads, and/or elongate shoulders, that support weight member 354 at its edges. Additionally, an optional resilient layer 378, which is preferably constructed of a resilient polymeric material such as polyurethane, or a resilient foam material. Similar to the previous embodiment, as fastener 358 is tightened it causes weight member 354 to be drawn onto step portions 376 and to flex. The flexing of weight member 354 increases the load on fastener 358 and draws projections 368 into détentes 372.

Now referring to FIGS. 37-40, a golf club head 390 includes a sole 392, a crown, a hitting face, a skirt 394, a hosel, and a weight member 396. Weight member 396 is attached to club head 390 at a weight mount 398. Weight member 396 and mount 398 are shaped and sized to complement each other and so that relative rotation is limited. For example, weight member 396 has a generally polygonal shape and mount 398 has a matching shape and is partially recessed into sole 392 so that when weight member 396 is installed it is prevented from rotation relative to mount 398.

Mount 398 is partially recessed and extends into a portion of sole 392 and skirt 394. Mount 398 is shaped to complement the shape of weight member 396 so that is provides alignment for weight member 396. Mount 398 includes a fastener portion 400 and a support portion 402. Fastener portion 400 includes a recess 404 that defines an abutment portion 405, such as an edge or surface. During installation of weight member 396, recess 404 receives a tapered portion of a fastener 406 that abuts abutment portion 405 and forces weight member 396 toward a bevel 408.

Bevel 408 extends from support portion 402 at a location of support portion 402 that is spaced from fastener 406 and fastener portion 400. Bevel 408 is angled relative to support portion 402 by a bevel angle α. Preferably, bevel angle α is acute relative to support portion 402.

Weight member 396 includes an angled abutment surface 412 and a fastener engagement feature 414. Angled abutment surface 412 is a surface that complements the shape of bevel 408 of mount 398 and that abuts bevel 408 when weight member 396 is installed on mount 398. Bevel 408 and abutment surface 412 are oriented so that as weight member 396 is forced into abutment with bevel 408, that abutment forces weight member 396 to be drawn tighter against sole 392 in mount 398.

Fastener engagement feature 414 of weight member 396 is a threaded bore that threadably engages a threaded portion of fastener 406. Fastener 406 is configured so that it forces weight member 396 toward bevel 408, generally along a translation axis A, as it is tightened in weight member 396. In the present embodiment, instead of utilizing the angle of the fastener relative to the golf club head or the interaction between the fastener and the weight member to drive the weight member toward the bevel, the engagement between fastener 406 and mount 398 is utilized. Fastener 406 includes a tapered engagement portion 416 and a threaded portion 418. Fastener 406 threads into a threaded bore 419 of weight member 396, and tapered engagement portion 416 abuts abutment portion 405 of weight mount 398.

The engagement between fastener 406 and mount 398 is constructed so that a component of force is directed toward bevel 408. In the present embodiment, another component of force is directed generally normal to support portion 400 and away from club head 390.

Figure 37:
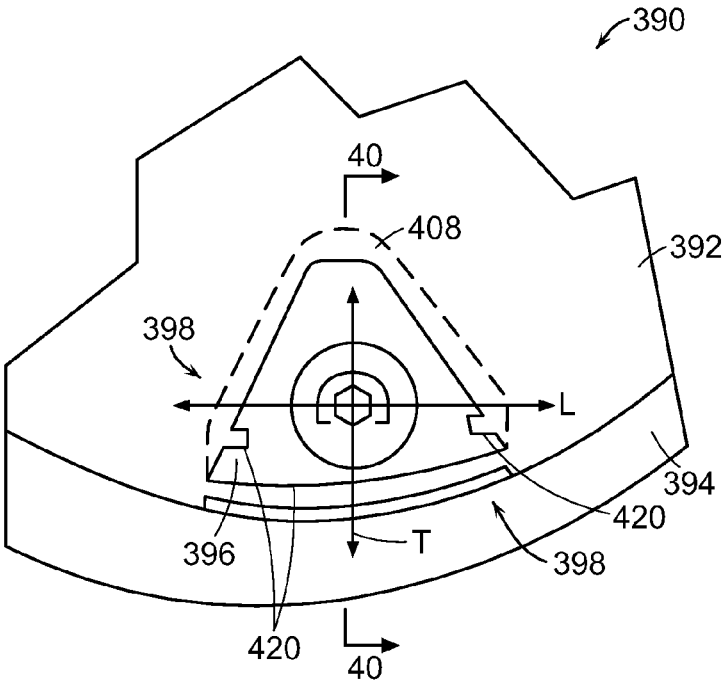
FIG. 37 is a plan view of an aft portion of another golf club head and an outer side of a removable weight member.
Figure 38:
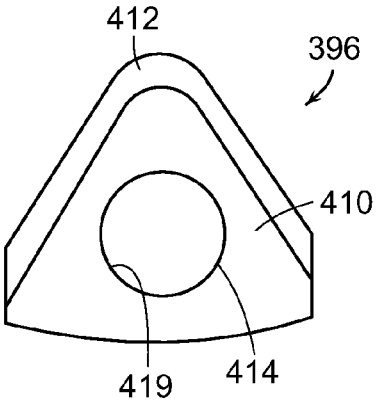
FIG. 38 is a plan view of the outer side of the removable weight member of FIG. 37.
Figure 39:
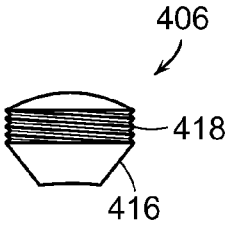
FIG. 39 is a side view of a fastener included in the golf club head of FIG. 37.
Figure 40:
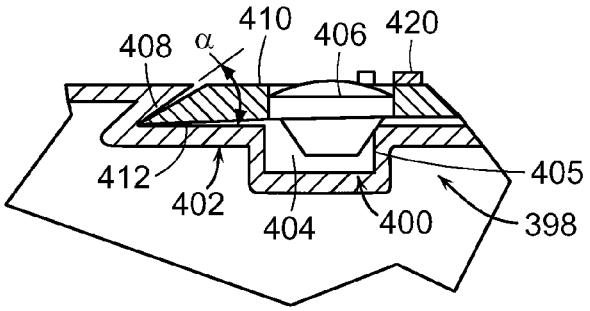
FIG. 40 is a cross-sectional view of the golf club head and removable weight member of FIG. 37.

The interaction between weight member 396 and mount 398 is constructed so that the component of force that is normal to support portion 400 is counteracted. As a result, weight member 396 is not lifted from mount 398 when fastener is tightened. For example, the length and location of bevel 408 may be selected to counteract the force. In particular, bevel 408 and angled abutment surface 412 of weight member 396 extend along a relatively large portion of the perimeter of the weight member 396, as shown in FIG. 37. In that example, bevel 408 extends from a location that is forward of recess 404 to a location that is aftward of recess 404. As shown in FIG. 37, bevel 408 extends from the forward most portion of mount 398 to a location that is spaced laterally from recess 404. As a result, a lateral axis L that is perpendicular to a translation axis T, and that extends through fastener 406 generally horizontal to sole 392, extends through a portion of bevel 408. Preferably, axis L extends through portions of bevel 408 on opposite heel and toe sides of weight member 396 so that an aft portion of weight member 396 is prevented from lifting from mount 398 when fastener 406 is tightened.

In addition, or as an alternative to bevel 408, one or more retainer 420 may be utilized that are spaced from bevel 408 so that fastener 406 is interposed between bevel and retainer 420. For example, retainer 420 is disposed on an opposite side of fastener 406 relative to bevel 408 in the direction corresponding to the orientation of axis T (e.g., in a fore/aft direction as shown). Retainer 420 may be a single member that extends across mount 398, or a plurality of retainers may be provided on opposite ends of mount 398. Retainer 420 is spaced from support portion 402 so that a space is provided that has a height dimension that is approximately equal to the thickness of weight member 396 so that weight member 396 is unable to move away from support portion 402 of mount 398 when fastener 406 is tightened.

Similar to previous embodiments, bevel angle $\alpha$ is selected so that as weight member 396 is forced into bevel 408, weight member 396 is forced against support portion 402 and tighter against sole 392. Bevel angle $\alpha$ is preferably 25°-65°, and more preferably 35°-55°.

Figure 41:
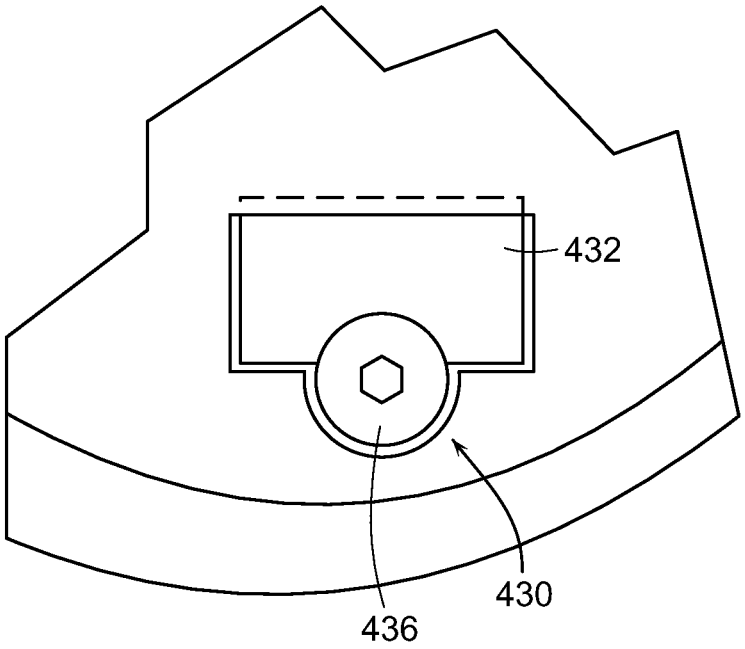
FIG. 41 is a plan view of an aft portion of another golf club head and an outer side of a removable weight member.
Figure 42:
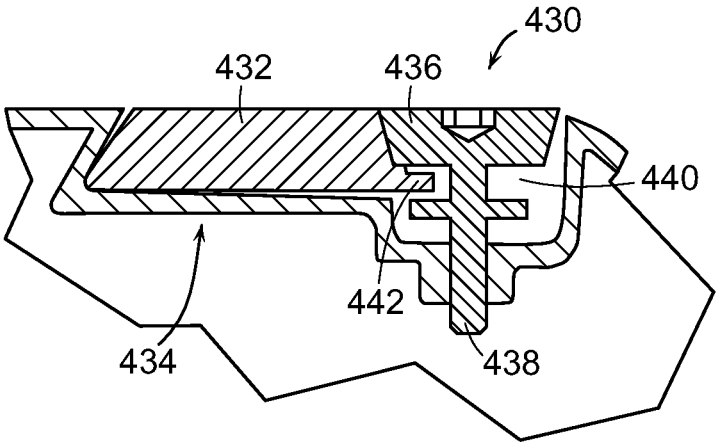
FIG. 42 is a cross-sectional view of the portion of the golf club head, removable weight member and fastener of FIG. 41.

Referring to FIGS. 41 and 42, an embodiment that includes engagement between a fastener and a weight member that assists in the removal of weight member from a recessed mount will be described. In particular, referring to FIGS. 41 and 42, a fastener 430 is employed to retain a weight member 432 on a mount 434. Fastener 430 generally includes a head 436 and a shank 438. Head 436 includes an intermediate neck portion 440 that receives an edge 442 of weight member 432. Neck portion 440 is dimensioned so that it receives a portion of edge 442 when weight member 432 is installed. As a result, when fastener 430 is removed, the lower portion of head 436 abuts edge 442 and lifts weight member 432 from mount 434.

Figure 43:
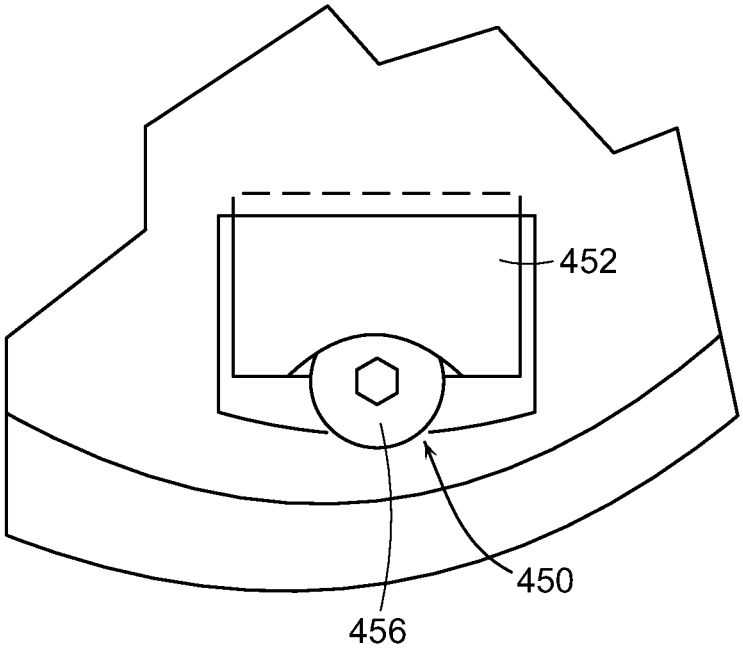
FIG. 43 is a plan view of an aft portion of another golf club head and an outer side of a removable weight member.
Figure 44:
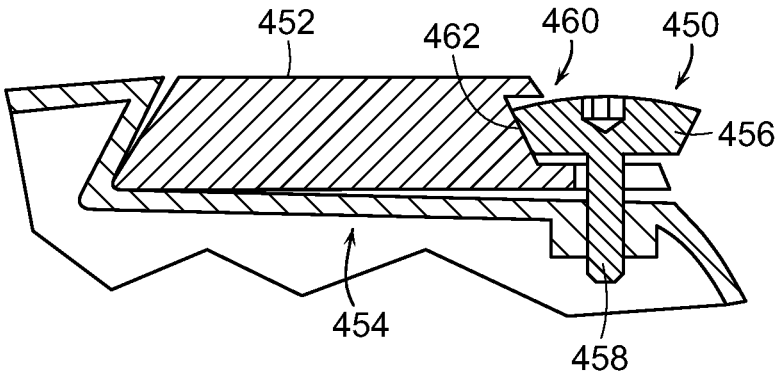
FIG. 44 is a cross-sectional view of the portion of the golf club head, removable weight member and fastener of FIG. 43.

In another embodiment, illustrated in FIGS. 43 and 44, a fastener 450 retains a weight member 452 on a mount 454. Fastener 450 includes a head 456 and a shank 458. Weight member 452 includes an edge 460 that defines a recess 462. When weight member 452 is installed on mount 454, recess 462 receives a portion of head 456 of fastener 450. Recess 462 and head 456 are dimensioned so that as fastener 450 is removed, the upper surface of head 456 abuts an upper edge of recess 462 and lifts weight member 450 from mount 454. Preferably, the upper surface of fastener 450 is curved convexly to provide smooth sliding between weight member 452 and fastener 450.

Figure 45:
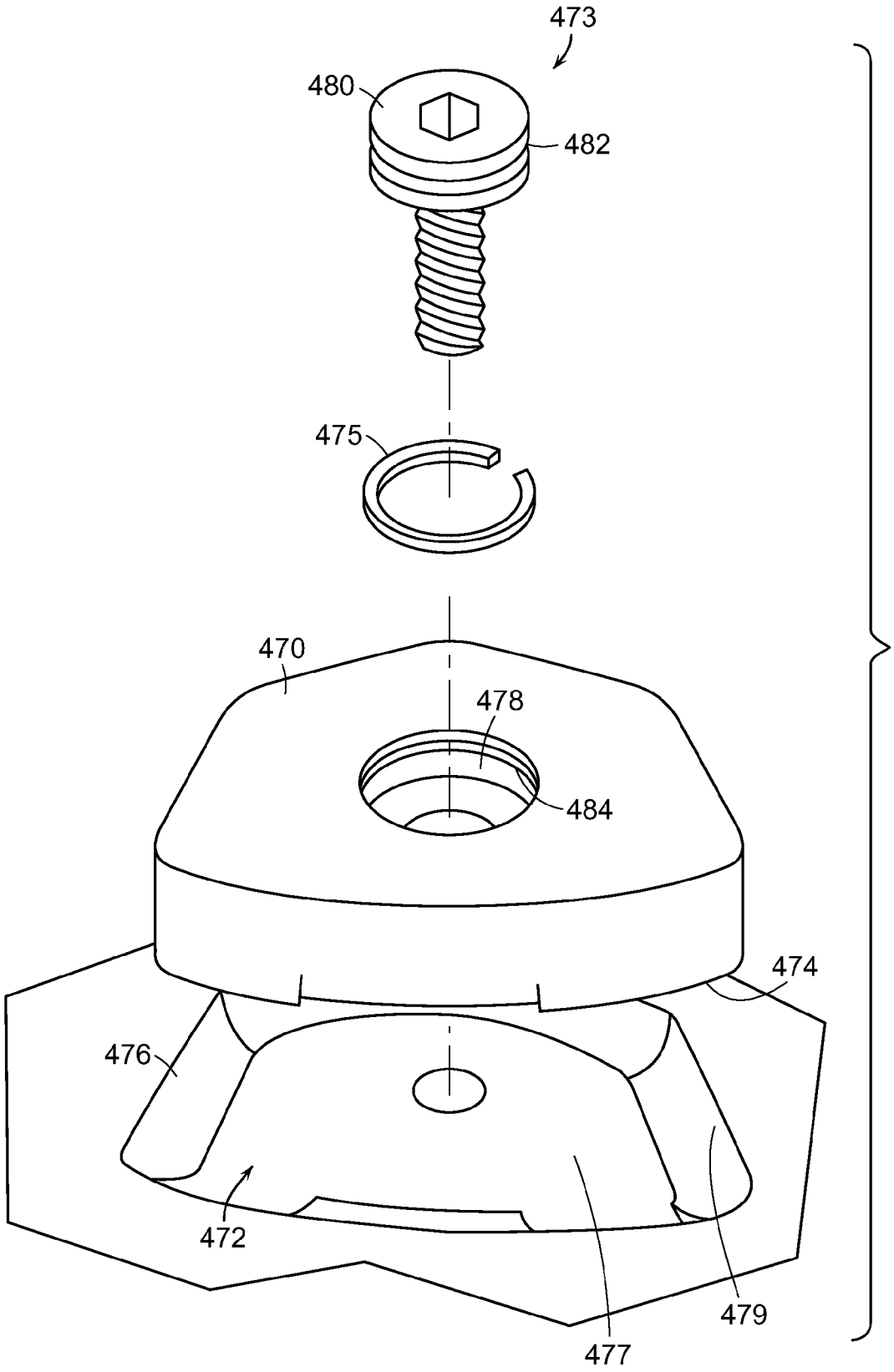
FIG. 45 is an exploded view of a portion of another golf club, removable weight member and fastener.
Figure 46:
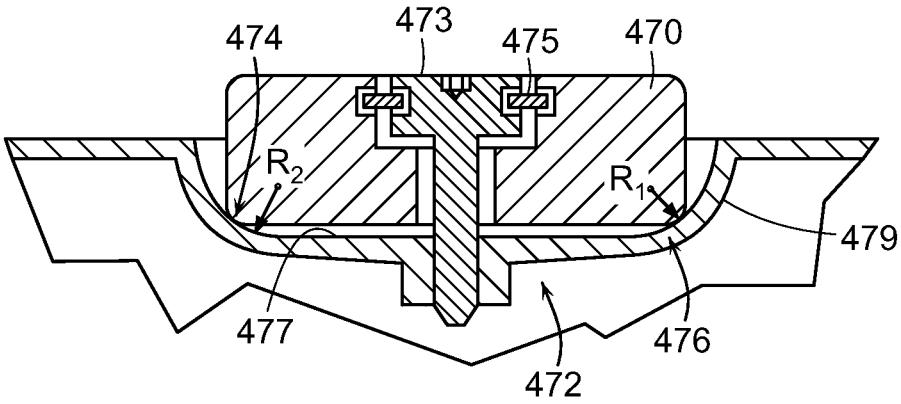
FIG. 46 is a cross-sectional view of the portion of another golf club head, removable weight member and fastener of FIG. 45.

Referring now to FIGS. 45 and 46, a weight member 470 is installed on a mount 472 using an elongate fastener 473. Both weight member 470 and mount 472 are constructed so that weight member 470 self-centers on mount 472. For example, the outer, lower edges 474 of weight member 470 formed by the junction of a lower surface and a side wall of weight member 470 are tapered. Additionally, the side wall 479 of mount 472 is tapered so that as the weight member 470 is drawn into mount 472, weight member 470 becomes centered by the sliding interaction of the tapers.

Mount 472 includes a base surface 477 and side wall 479 that extends between base surface 477 and an adjacent portion of the club head body. In the illustrated embodiment, at least a portion of side wall 479 and the lower corners 476 of mount 474, and the outer and lower edges 474 of weight member 470 are tapered with radiuses, but it should be appreciated that they may alternatively be chamfered and/or radiused. In particular, lower edges 474 of weight member 470 are tapered with radius R1 and side wall 479 of mount 472 are tapered by radius R2, and radius R1 is less than radius R2.

In the present embodiment, weight member 470 is rotatably coupled to fastener 473 by a retainer 475. Weight member 470 includes a bore 478 that receives fastener 473 and at least a portion of a fastener head 480. A portion of fastener 473 includes a circumferential channel 482 that is configured to receive a portion of retainer 475 when fastener 473 is assembled with weight member 470, as shown in FIG. 46. Bore 478 also includes a circumferential channel 484 that receives a portion of retainer 475 in the assembly.

Figure 57:
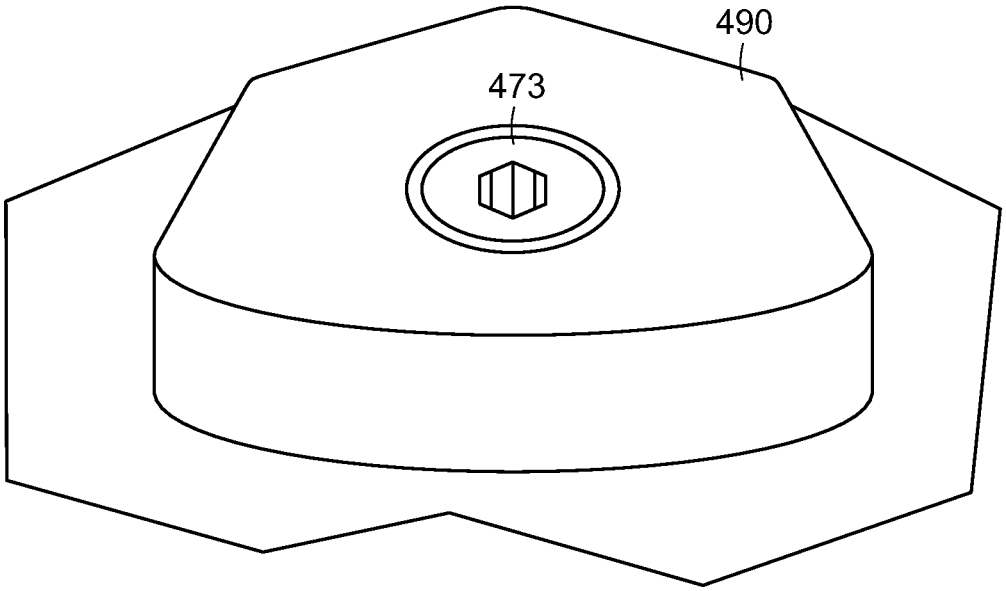
FIG. 57 is an exploded view of a portion of another golf club, removable weight member and fastener.
Figure 58:
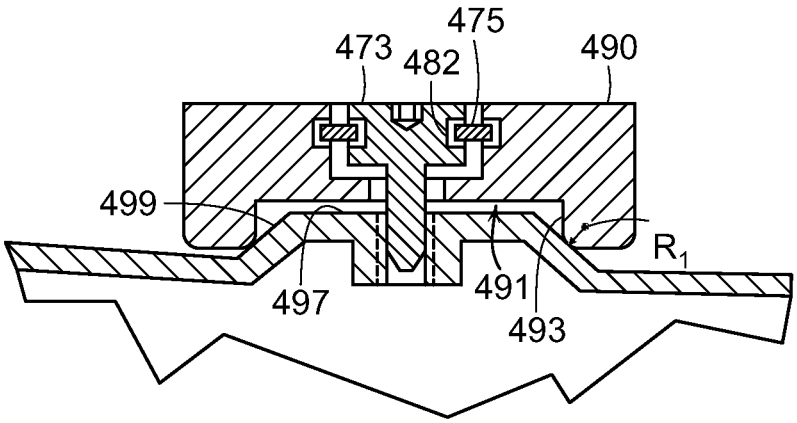
FIG. 58 is a cross-sectional view of the portion of another golf club head, removable weight member and fastener of FIG. 57.

In a similar embodiment, illustrated in FIGS. 57 and 58, a weight member 490 is installed on a mount using an elongate fastener 473 and self-centers on a mount 492. Mount 492 projects from an adjacent portion of the club head and includes a base surface 497 and a side wall 499 that extends between base surface 497 and the adjacent portion of the club head. The junction between side wall 499 and the adjacent portion of the club head body forms lower corners 496. At least a portion of side wall 499, preferably at or adjacent lower corners 496, of mount 492 are tapered. Additionally, weight member 490 includes a recess 491, that receives the projected mount 492, and that is defined by side wall 493. The inner, lower edges of side wall 493 of weight member 490 are tapered so that weight member 490 becomes centered on mount 492 by sliding interaction. In particular, lower edges 494 of weight member 490 are tapered with radius R1 and side wall 499 of mount 492 is tapered with a chamfer. As a result, the radius of weight member 490 slides along side wall 499 as fastener 473 draws weight member 490 toward mount 492 and weight member 490 self-centers on mount 492. Fastener 473 includes a circumferential channel 482 that receives a retainer 475 when fastener 473 is assembled with weight member 490.

Figure 59:
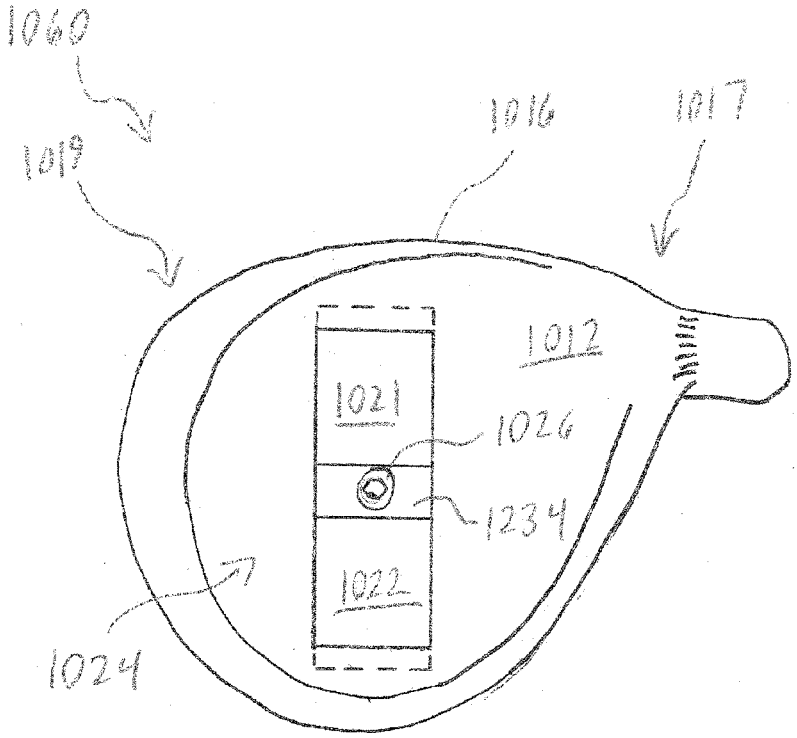
FIG. 59 is a plan view of one embodiment of a golf club head including a weight mount, a single fastener, a retainer, and two weight members.
Figure 60:
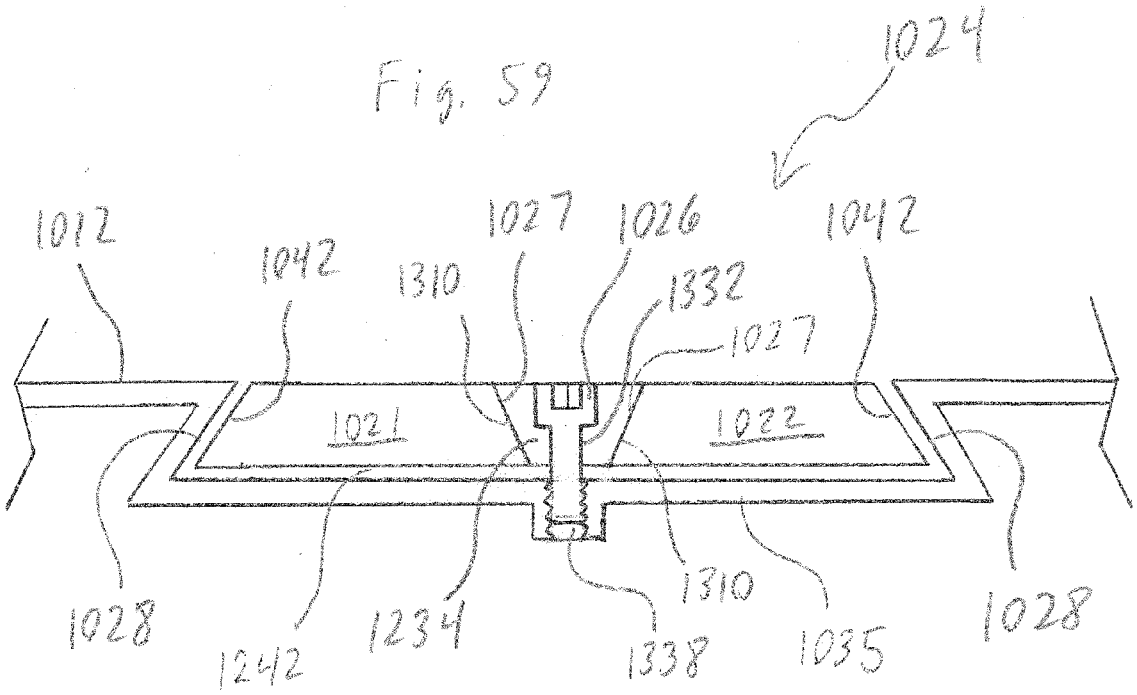
FIG. 60 is a cross-sectional view of the weight mount of FIG. 59.

In another embodiment, as illustrated in FIGS. 59 and 60, the sole 1012 of the golf club head 1060 can include a weight mount 1024, which is configured to couple a plurality of weight members 1021, 1022 to the sole 1012. In some embodiments, the weight mount 1024 can be configured to couple two weight members 1021, 1022 to the golf club head 1060 with a single fastener 1026. In the illustrated embodiment, the weight mount 1024 can comprise a recessed portion of the sole 1012, forming a weight recess 1242 that is shaped to complement the shape of a first weight member 1021 and a second weight member 1022.

In some embodiments, the weight mount 1024 can include a first end a second end. The first end can be opposite the second end. As illustrated in FIGS. 59 and 60, the weight mount 1024 can include a first undercut 1028 located at said first end and a second undercut 1028 located at said second end. In some embodiments, as illustrated in FIGS. 59 and 60, the undercut 1028 can comprise a bevel. Other embodiments of undercuts 1028 are illustrated in FIG. 62-65. The weight mount 1024 can also include a support surface 1035 located between the first and second ends of the weight mount 1024. The support surface 1035 can include a threaded bore 1338 configured to engage a fastener 1026.

Figure 61:
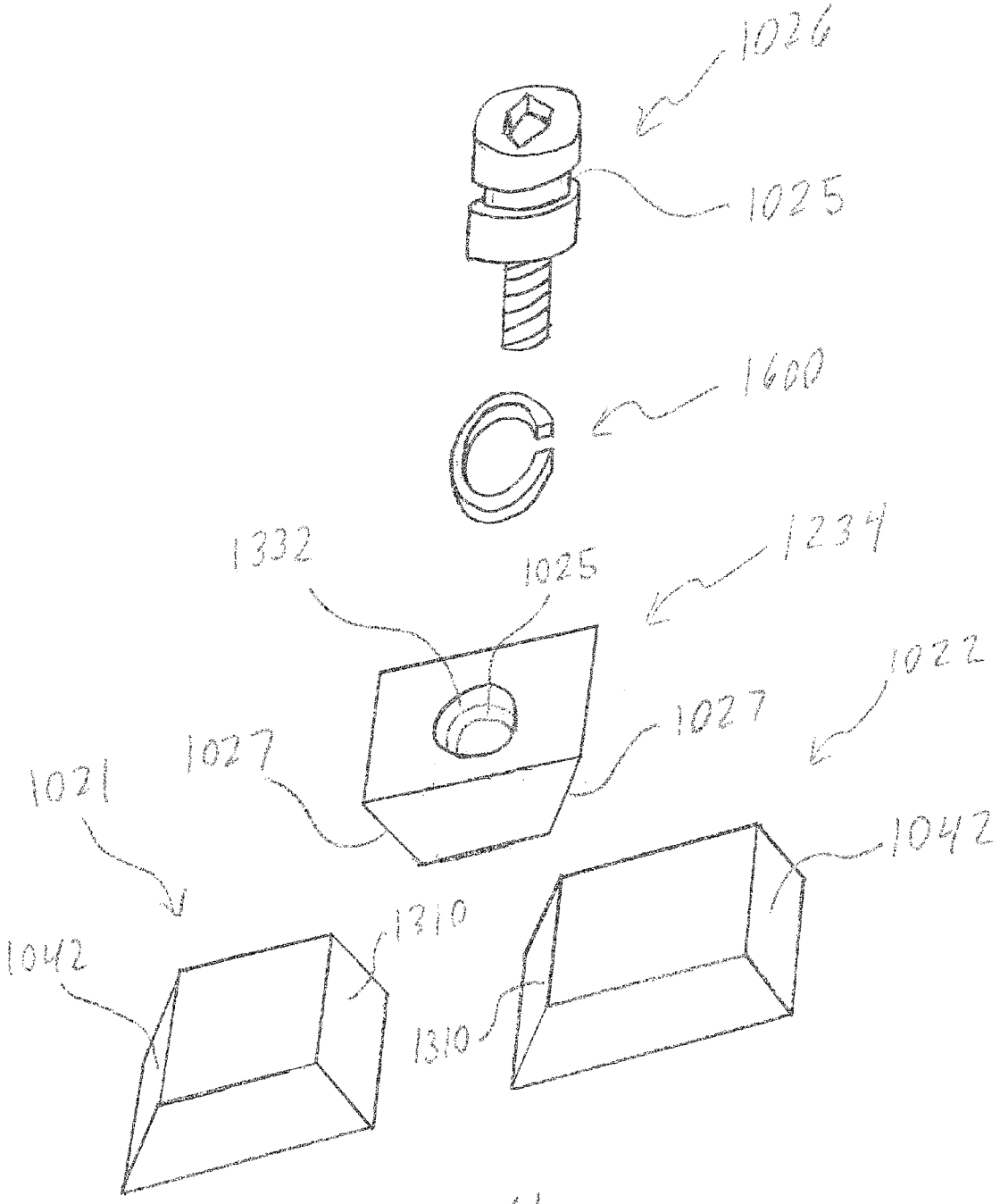
FIG. 61 is a perspective view of one embodiment of a fastener, retainer, and two weight members.

As illustrated in FIG. 59-61, the golf club head 1060 can include a first weight member 1021 and a second weight member 1022. The weight members 1021, 1022 can be configured to couple to the weight mount 1024. Each weight member 1021, 1022 can include an abutment surface 1042. Each abutment surface 1042 can be configured to be received in each undercut 1028. In some embodiments, as illustrated in FIG. 60, the abutment surface 1042 of each weight member 1021, 1022 can be angled. The angled abutment surface 1042 can be adapted to abut at least a portion of the beveled undercut 1028. The angled abutment surface 1042 engaging the beveled undercut 1028 can force the first and second weight members 1021, 1022 towards the support surface 1035 as the weight members 1021, 1022 are forced towards the undercut 1028, locking the weight members 1021, 1022 in place.

In some embodiments, as illustrated in FIGS. 59-61, 66, and 67, the golf club head 1060 can also include a single fastener 1026, 2026 configured to selectively couple the first weight member 1021 and second weight member 1022 to the weight mount 1024. The fastener 1026, 2026 can be configured to force the first weight member 1021 and second weight member 1022 towards the first and second undercuts 1028 when the fastener 1026, 2026 is rotated relative to the threaded bore 1338, tightening the fastener 1026, 2026 into a locked position.

In some embodiments, as illustrated in FIGS. 60 and 61, the first and second weight members 1021, 1022 can include a tapered portion 1310. The tapered portion 1310 of the first weight member 1021 can be opposite the abutment surface 1042 of the first weight member 1021 and the tapered portion 1310 of the second weight member 1022 can be opposite the abutment surface 1042 of the second weight member 1022. The golf club head 1060 can include a retainer 1234 configured to engage said first weight member 1021 and said second member 1022. The retainer 1234 can be configured to engage the tapered portions 1310 of the weight members 1021, 1022. The retainer 1234 can be located between the first weight member 1021 and the second weight member 1022. The retainer 1234 can include a fastener bore 1332 configured to accept the fastener 1026. In some embodiments, the fastener 1026 can be rotatably coupled to the retainer 1234. The fastener 1026 and retainer 1234 can each include a snap ring groove 1025 to engage a snap ring 1600, the snap ring 1600 rotatably coupling the fastener 1026 to the retainer 1234.

In some embodiments, as illustrated in FIGS. 60 and 61, the retainer 1234 can include tapered engagement portions 1027 configured to engage the tapered portions 1310 of the first and second weight members 1021, 1022. The retainer 1234 can be configured to exert a force on the first and second weight members 1021, 1022 both towards the support surface 1035 and substantially parallel to the support surface 1035 away from the retainer 1234. The retainer 1234 can force the first weight member 1021 and the second weight member 1022 laterally towards the first and second undercuts 1028 when the fastener 1026 is tightened into the locked position, the undercuts 1028 forcing the weight members 1021, 1022 towards the support surface 1035. The tapered engagement portions 1027 of the retainer 1234 can slide along the tapered portions 1310 of the weight members 1021, 1022 as the retainer 1234 moves towards the support surface 1035 and the weight members 1021, 1022 slide towards the undercuts 1028.

In some embodiments, as illustrated in FIG. 59-61, the fastener 1026 can be arranged substantially perpendicular to the support surface 1035. As the fastener 1026 is rotated within the threaded bore 1338 it can translate towards or away from the support surface 1035. The fastener 1026 can thus force the retainer 1234 towards the support surface 1035. In some embodiments, tightening of the fastener 1026 and translation of the fastener 1026 and retainer 1234 towards the support surface 1035 can cause the first weight member 1021 and second weight member 1022 to move in directions substantially perpendicular to the translation of the fastener 1026. In some embodiments, as illustrated in FIG. 59-61, the tightening of the fastener 1026 can cause the first weight member 1021 to move in a direction substantially opposite that of the second weight member 1022.

Figure 66:
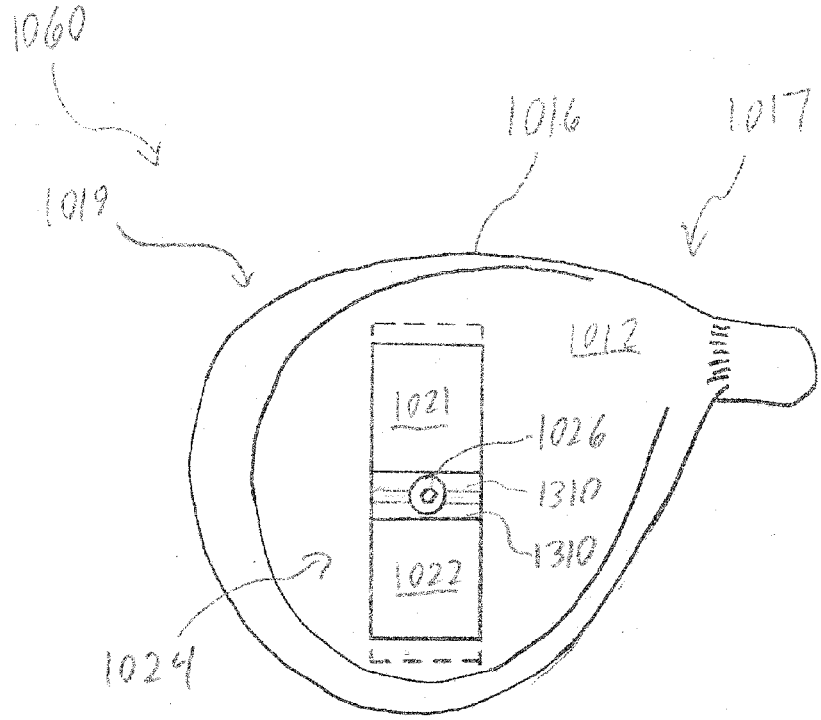
FIG. 66 is a plan view of one embodiment of a golf club head including a weight mount, a single fastener, and two weight members.
Figure 67:
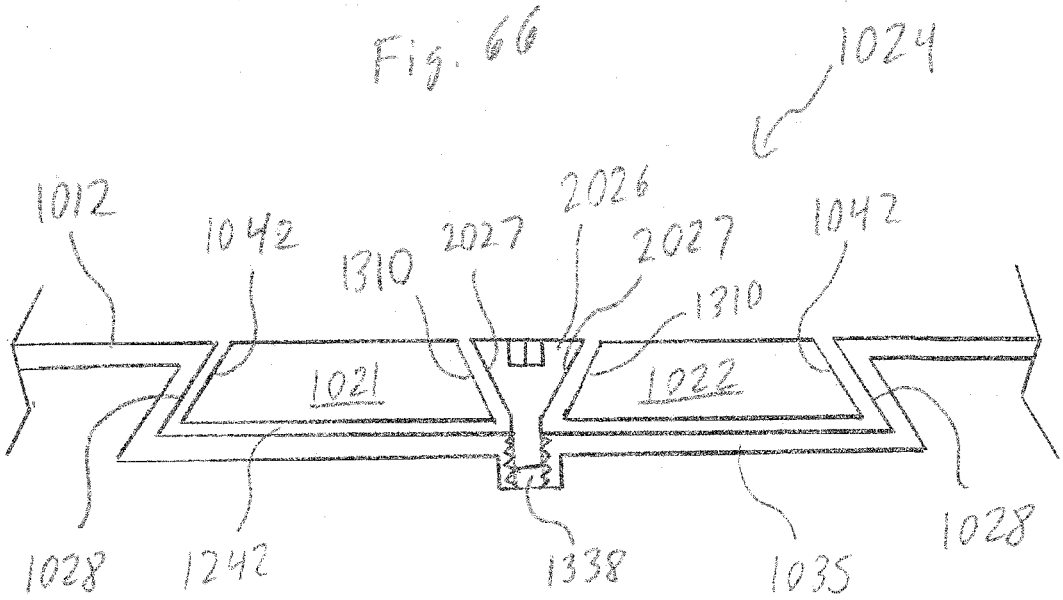
FIG. 67 is a cross-sectional view of the weight mount of FIG. 66.
Figure 68:
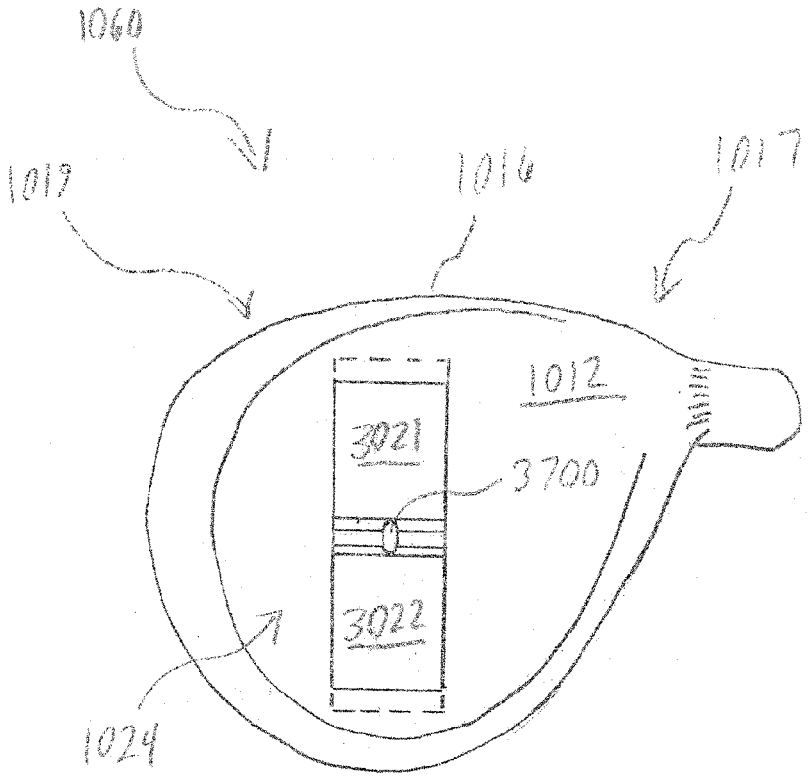
FIG. 68 is a plan view of one embodiment of a golf club head including a weight mount, a cam, and two weight members.

In some embodiments, as illustrated in FIGS. 66 and 67, the fastener 2026 can directly engage the first weight member 1021 and second weight member 1022. The fastener 2026 can include a tapered engagement portion 2027 configured to engage the tapered portions 1310 of the first weight member 1021 and second weight member 1022 as the fastener 2026 is rotated and translates towards the support surface 1035. The tapered engagement portion 1310 can exert a force on the first and second weight members 1021, 1022 in both the direction towards the support surface 1035 and in a direction substantially parallel to the support surface 1035, away from the fastener 2026, forcing the abutment surfaces 1042 of the first and second weight members 1021, 1022 into the undercuts 1028 of the weight mount 1024, locking the first and second weight members 1021, 1022 in place.

The first weight member 1021 can comprise a mass different than the mass of the second weight member 1022. The first weight member 1021 can comprise a different geometry, include a different number or size of relief bores, or comprise a different material than the second weight member 1022. In some embodiments, as illustrated in FIGS. 59-61, 66, and 67, the weight members 1021, 1022 can be interchangeable, providing an adjustment of the location of the center of gravity of the golf club head 1060, by loosening the fastener 1026, 2026. In some embodiments, the fastener 1026, 2026 can be removed to remove the weight members 1021, 1022. In some embodiments, the retainer 1234 can be removed to remove the weight members 1021, 1022. In some embodiments, as illustrated in FIG. 59, the first end of the weight mount 1024 can be located closer to the striking face 1016 of the golf club head 1060 and the second end of the weight mount 1024 can be located aftward of the first end of the weight mount 1024, closer to the rear of the golf club head 1060. In another embodiment, the first end of the weight mount 1024 can be located closer to the toe 19 of the golf club head 1060 and the second end of the weight mount can be located closer to the heel 17 of the golf club head 1060.

Figure 62:
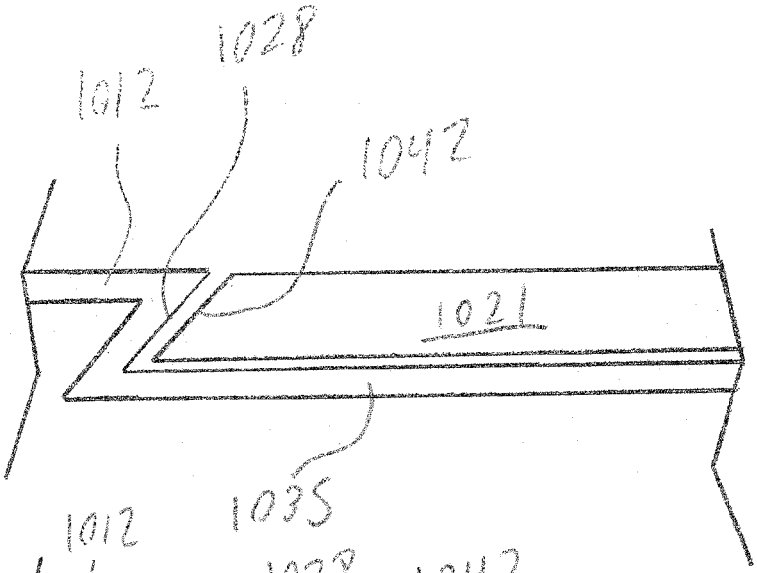
FIG. 62-65 illustrate cross-sectional views of additional embodiments of undercuts and abutment surfaces.

The undercuts 1028 of the weight mount 1024 and abutment surfaces 1042 of the weight members 1021, 1022 can comprise various geometries, which may include for example, those illustrated in FIG. 62-65. As illustrated in FIG. 62, the undercut 1028 can comprise a bevel and the abutment surface 1042 can comprise an angle. As the weight member 1021 is forced towards the undercut 1028, the abutment surface 1042 engages the undercut 1028, which clamps the weight member 1021 down towards the support surface 1035 and locks the weight member 1021 in place.

Figure 63:
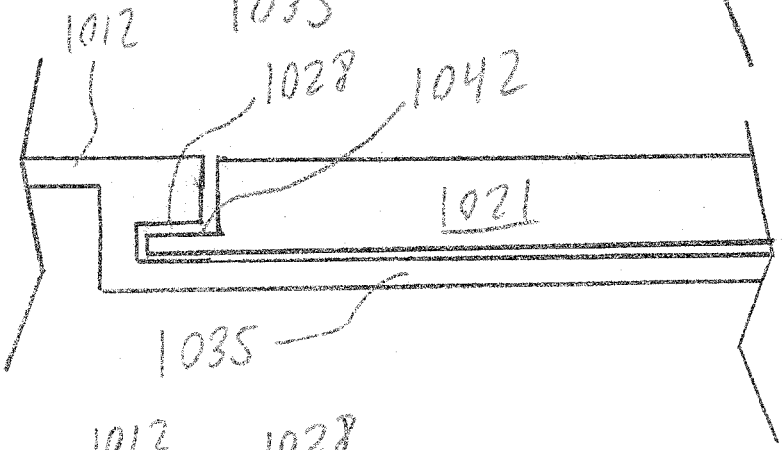

As illustrated in FIG. 63, the undercut 1028 can comprise a channel and the abutment surface 1042 can comprise a flange, configured to extend into the channel. As the weight member 1021 is forced towards the undercut 1028, the flange can enter the channel, locking the weight member 1021 in place. In some embodiments, the undercut 1028 and abutment 1042 surface may be angled to further limit movement of the weight member.

Figure 64:
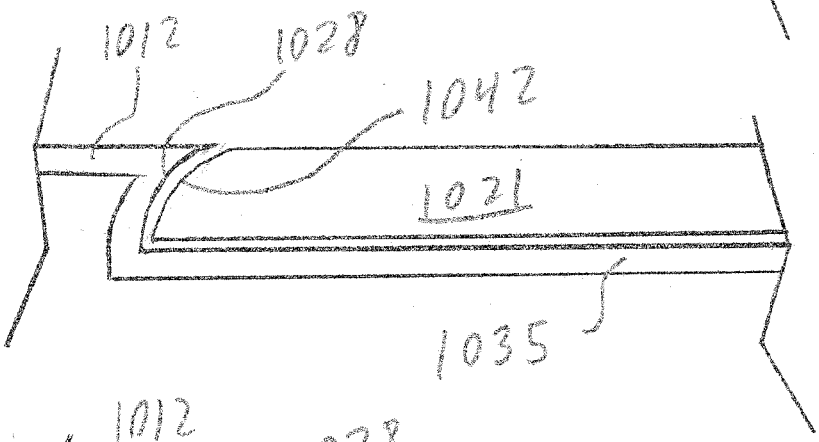

As illustrated in FIG. 64, the undercut 1028 can comprise a curved surface and the abutment surface 1042 can be curved. As the weight member 1021 is forced towards the undercut 1028, the curved abutment surface 1042 engages the curved undercut 1042, which clamps the weight member 1021 down towards the support surface 1035 and locks the weight member 1021 in place.

Figure 65:
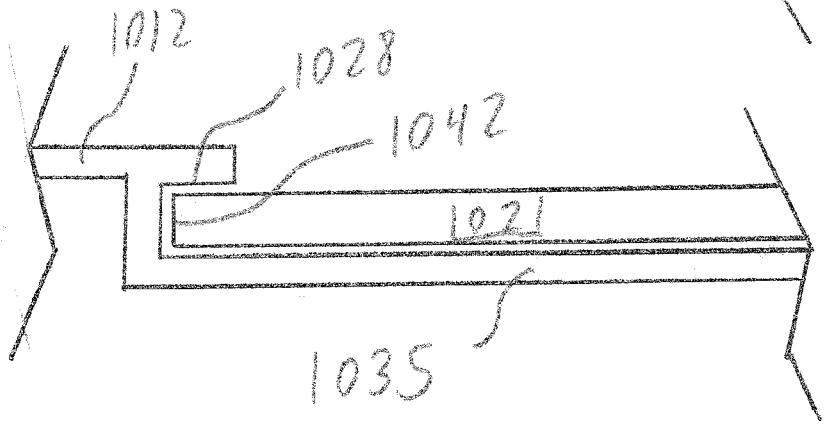

As illustrated in FIG. 65, the undercut 1028 can comprise a channel which is configured to receive at least a portion of the weight member 1021. The abutment surface 1042 of the weight member 1021 can comprise a rectangular shape configured to be received in the channel. As the weight member 1021 is forced towards the undercut 1028, the abutment surface 1042 can enter the channel, locking the weight member 1021 in place. In some embodiments, the undercut 1028 and abutment surface 1042 may be angled to further limit movement of the weight member 1021.

In some embodiments, as illustrated in FIG. 68-74, the weight mount 1024 can include a cam 3700 configured to selectively retain the weight members 3021, 3022 in the weight mount 1024. The weight members 3021, 3022 can each include a cam engagement portion 3310 opposite the abutment surface 1042 of each weight member 3021, 3022. In some embodiments, as illustrated in FIG. 68-72, the cam engagement portion 3010 can comprise a shelf, allowing the cam 3700 to both exert a force laterally and substantially parallel to the support surface 1242 on each weight member 3021, 3022, but also a force towards the support surface 1035, retaining the weight members 3021, 3022 in the weight mount 1024 when the cam 3700 is in a locked position. The cam 3700 can be rotatably coupled to the golf club head 1060. The support surface 1035 of the weight mount 1024 can include a cam bore 3338 configured receive a portion of the cam 3700 and allow the cam 3700 to rotate relative to the weight mount 1024. The cam 1024 can be located between the first weight member and the second weight member.

Figure 69:
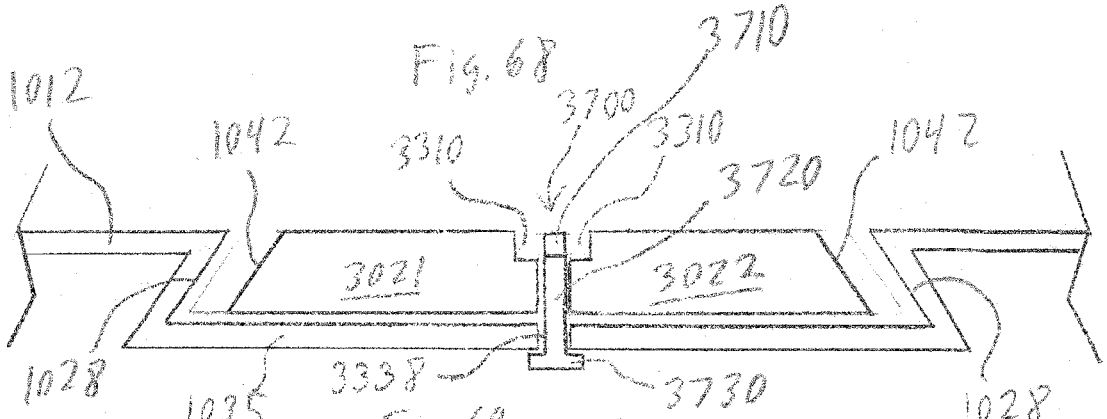
FIG. 69 is a cross-sectional view of the weight mount of FIG. 68 in an unlocked position.
Figure 70:
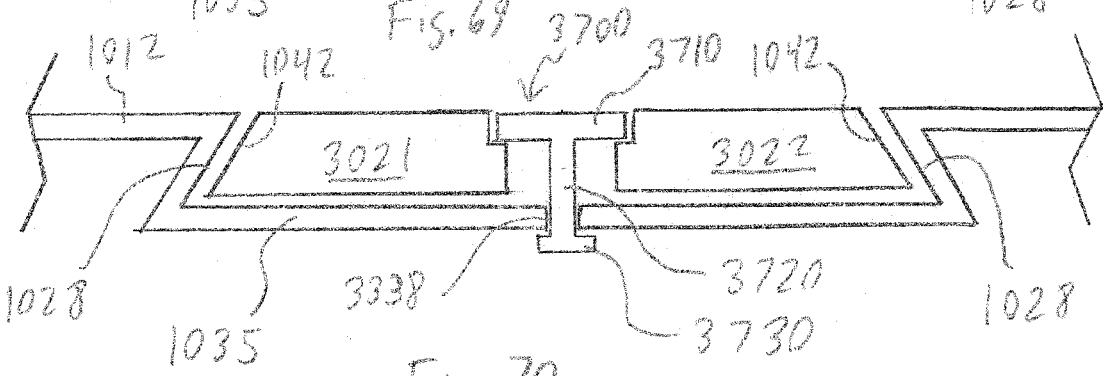
FIG. 70 is a cross-sectional view of the weight mount of FIG. 68 in a locked position.
Figure 71:
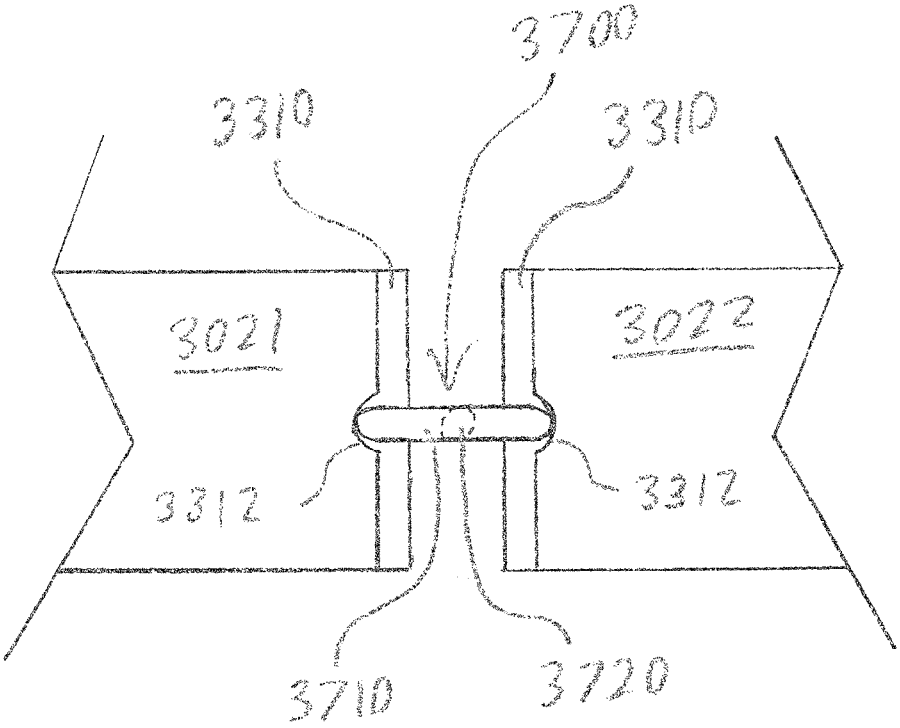
FIG. 71 is a plan view of one embodiment of a weight mount including a cam in a locked position.
Figure 72:
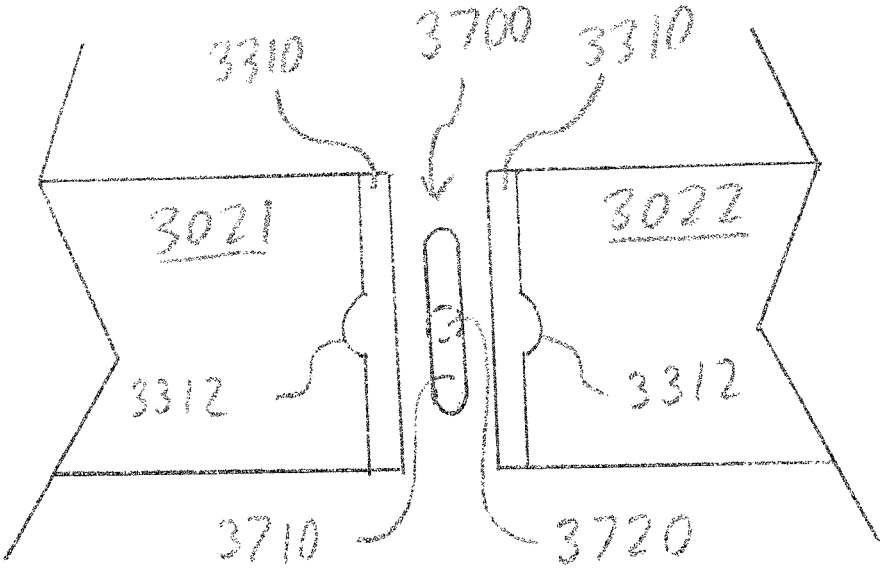
FIG. 72 is a plan view of the weight mount of FIG. 71 in an unlocked position.

As illustrated in FIG. 69-72, the cam 3700 can rotate between a locked position, as illustrated in FIGS. 70 and 71, and an unlocked position, as illustrated in FIGS. 69 and 72. The cam 3700 can include a dynamic portion 3720, the dynamic portion 3720 extending further outward laterally towards the first and second weight members 3021, 3022 when the cam 3700 is in a locked position than when the cam 3700 is in an unlocked position. The cam 3700 is configured to contact the cam engagement portion 3310 of the first weight member 3021 and the second weight member 3022, forcing the first weight member 3021 and second weight member 3022 towards the undercuts 1028, when the cam 3700 is rotated from an unlocked position, as illustrated in FIGS. 69 and 72, to a locked position, as illustrated in FIGS. 70 and 71. The first undercuts 1028 and cam 3700 are configured to prevent the first and second weight members 3021, 3022 from moving relative to the weight mount 1024 when the cam 3700 is in a locked position. In other embodiments, not illustrated, the dynamic portion of the cam can include a tapered engagement portion and the weight members can include a tapered portion, similar to the embodiment illustrated in FIGS. 66 and 67, however the cam would be rotatably coupled to the weight mount and the dynamic portion of the cam would extend outward laterally towards the first and second weight members when in a locked position than when the cam is in an unlocked position. In some embodiments, as illustrated in FIGS. 69 and 70, the weight members 3021, 3022 can be interchangeable, providing an adjustment of the location of the center of gravity of the golf club head 1060, by unlocking the cam 3700 and removing each weight member 3021, 3022.

In some embodiments, as illustrated in FIGS. 71 and 72, the cam engaging portions 3310 of the first and second weight members 3021, 3022 can include locking features 3312 configured to lock the cam 3700 in the locked position. The locking features 3312 can comprise a recess configured to receive at least a portion of the dynamic portion 3710 of the cam 3700 when the cam 3700 is in a locked position. FIG. 71 illustrates the cam 3700 in a locked position and FIG. 72 illustrates the cam 3700 in an unlocked position. In some embodiments, the undercuts 1028 can include a compressible layer which may include for example, rubber, plastic, foam, etc. In some embodiments, the abutment surface 1042 can comprise a compressible layer. The compressed compressible layers can force the weight members 3021, 3022 back towards the cam 3700, requiring additional force for the cam 3700 to rotate and exit the locking feature 3312, locking the cam 3700 and weight members 3021, 3022 in place.

Figure 73:
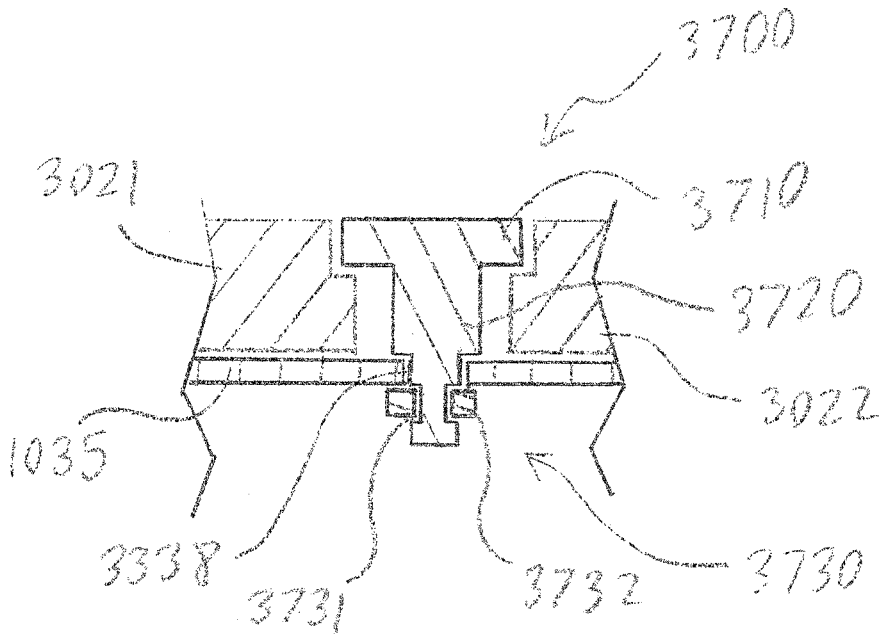
FIG. 73 is a cross-sectional view of one embodiment of a cam.
Figure 74:
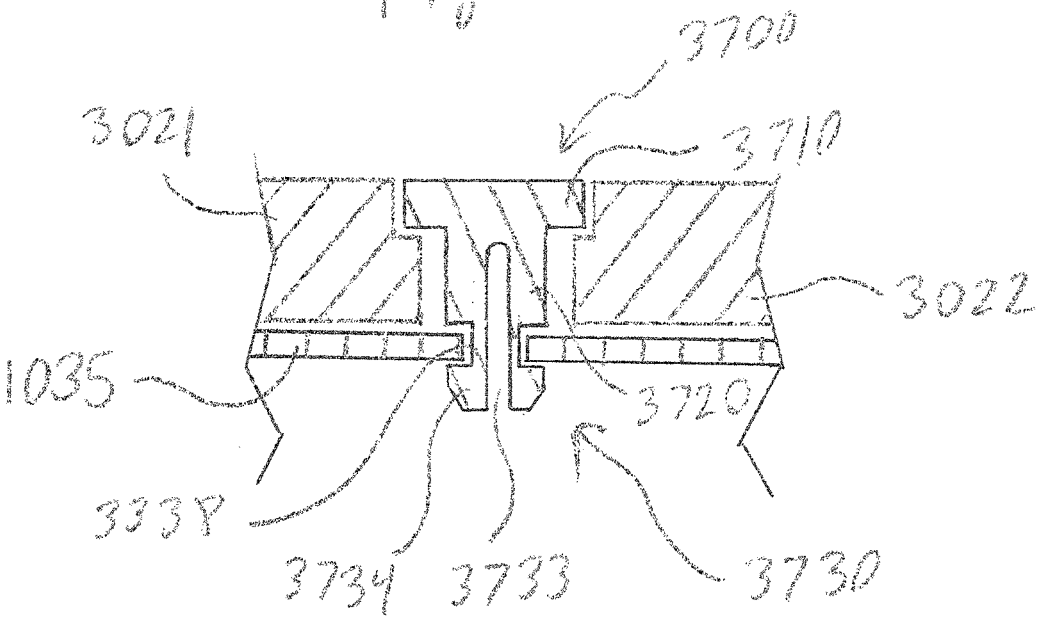
FIG. 74 is a cross-sectional view of one embodiment of a cam.

In some embodiments, as illustrated in FIGS. 69, 70, 73, and 74 the cam can include a body 3720 affixed to the dynamic portion 3710 of the cam 3700. The body 3720 can be formed integrally to the dynamic portion 3710. At least a portion of the body 3720 can be configured to pass through the cam bore 3338 of the weight mount 1024 formed in the support surface 1035. In some embodiments, the cam 3700 can include a cam retaining member 3730 affixed to the body 3720 of the cam 3700, the cam retaining member 3730 configured to prevent the cam 3700 from becoming disconnected from the weight mount 1024. Various embodiments of cam retaining members 3730 are illustrated in FIGS. 73 and 74. As illustrated in FIG. 73, the cam 3700 can include a snap ring groove 3731 and receive a snap ring 3732, limiting the cam 3700 from being removed from the cam bore 3338. As illustrated in FIG. 74, the cam 3700 can include at least one relief slot 3733, forming a plurality of deflectable portions 3734 which spring into a locked configuration after passing through the cam bore 3338, limiting the cam 3700 from being removed from the cam bore 3338. In some embodiments, the cam 3700 can comprise a snap fit into the cam bore 3338.

In other embodiments, the weight mount does not necessarily form a recess. In some embodiments, the support surface can be flush with laterally adjacent portions of the sole of the golf club head. The undercuts can protrude out from the sole of the golf club head to engage the weight members.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

The invention claimed is:

1. A golf club head, comprising:

a hosel;

a ball striking face;

a sole extending aftward from a lower edge of said striking face;

a crown extending aftward from an upper edge of said striking face;

a skirt extending between said sole and said crown;

a weight mount disposed on at least one of the sole, the crown and the skirt;

wherein said weight mount comprises a first end and a second end, said first end opposite said second end;

where said weight mount comprises a first undercut located at said first end, a second undercut located at said second end, and a support surface located between said first end and said second end;

a first weight member and a second weight member, said first weight member and said second weight member each including an abutment surface, wherein at least a portion of said abutment surface of said first weight member is received in said first undercut, wherein at least a portion of said abutment surface of said second weight member is received in said second undercut;

a fastener configured to force said first weight member towards said first undercut and said second weight member towards said second undercut;

wherein said first undercut, said second undercut, and said fastener are configured to limit said first weight member and said second weight member from moving relative to said weight mount.

2. The golf club head of claim 1, wherein said first and second weight members each comprise a tapered portion, said tapered portion of said first weight member opposite said abutment surface of said first weight member and said tapered portion of said second weight member opposite said abutment surface of said second weight member.

3. The golf club head of claim 2, further comprising a retainer located between said first weight member and said second weight member, wherein said support surface comprises a threaded bore configured to engage said fastener, wherein said retainer comprises a fastener bore configured to receive a portion of said fastener, wherein said retainer comprises a first tapered engagement portion configured to engage said tapered portion of said first weight member and a second tapered engagement portion configured to engage said tapered portion of said second weight member, wherein said retainer is configured to force said first weight member towards said first undercut and said second weight member towards said second undercut, and wherein said first undercut is configured to force said first weight member towards said support surface and said second undercut is configured to force said second weight member towards said support surface.

4. The golf club head of claim 3, wherein said fastener is rotatably coupled to said retainer wherein said fastener is configured to translate along with said retainer but rotate relative to said retainer.

5. The golf club head of claim 3, wherein said first undercut comprises a bevel, said second undercut comprises a bevel, said abutment surface of said first weight member is angled and abuts at least a portion of said first undercut, and said second abutment surface of said second weight member is angled and abuts at least a portion of said second undercut.

6. The golf club head of claim 5, wherein said fastener is arranged substantially perpendicular to said support surface, said fastener is configured to force said retainer towards said support surface, and wherein said first weight member and said second weight member move in directions substantially perpendicular to the translation of said fastener and said first weight member moves in a direction substantially opposite that of said second weight member when said fastener is tightened into a locked position.

7. The golf club head of claim 1, wherein said first weight member comprises a mass different than the mass of said second weight member and wherein said first weight member and said second weight member are interchangeable, providing an adjustment of the location of the center of gravity of said golf club head.

8. The golf club head of claim 1, wherein said first end of said weight mount is located closer to said striking face of said golf club head and said second end of said weight mount is located aftward of said first end of said weight mount.

9. The golf club head of claim 1, wherein said golf club head comprises a toe and a heel, wherein said first end of said weight mount is located closer to said toe of said golf club head and wherein said second end of said weight mount is located closer to said heel of said golf club head.

10. The golf club head of claim 1, wherein said first and second weight members each have a generally polygonal perimeter shape.

11. The golf club head of claim 1, wherein said fastener comprises a cam rotatably coupled to said golf club head, said cam located between said first weight member and said second weight member, wherein said first and second weight member each comprise a cam engagement portion, said cam engagement portion of said first weight member opposite said abutment surface of said first weight member and said cam engagement portion of said second weight member opposite said abutment surface of said second weight member, wherein said cam is configured to rotate between a locked position and an unlocked position, wherein said cam is configured to contact said cam engagement portion of said first weight member and said cam engagement portion of said second weight member, forcing said first weight member and said second member towards said first undercut and said second undercut when said cam is rotated from an unlocked position to a locked position, wherein said first undercut, said second undercut, and said cam are configured to limit said first weight member and said second weight member from moving relative to said weight mount when said cam is in said locked position, and wherein said first weight member and said second weight member are removable when said cam is in an unlocked position.

12. The golf club head of claim 11, wherein said cam comprises a dynamic portion, said dynamic portion extending further outward towards said first and second weight members when in said locked position than when said cam is in said unlocked position.

13. The golf club head of claim 12, wherein said support surface comprises a cam bore, wherein said cam comprises a body portion connected to said dynamic portion, wherein a portion of said body of said cam passes through said cam bore, and wherein said cam comprises a cam retaining member configured to prevent said cam from becoming disconnected from said golf club head.

14. The golf club head of claim 13, wherein at least one of said cam engaging portions of said first and second weight members comprises a locking feature configured to lock said cam in said locked position, and wherein said locking feature comprises a recess configured to receive said dynamic portion of said cam when said cam is in said locked position.

15. The golf club head of claim 12, wherein said first undercut comprises a bevel, said second undercut comprises a bevel, said abutment surface of said first weight member is angled and abuts at least a portion of said first undercut, and said second abutment surface of said second weight member is angled and abuts at least a portion of said second undercut.

16. The golf club head of claim 12, wherein said first weight member comprises a mass different than the mass of said second weight member and wherein said first weight member and said second weight member are interchangeable, providing an adjustment of the location of center of gravity of said golf club head, by rotating said cam to said unlocked position.

17. A golf club head, comprising:

a hosel;

a ball striking face;

a sole extending aftward from a lower edge of said striking face;

a crown extending aftward from an upper edge of said striking face;

a skirt extending between said sole and said crown;

a weight mount disposed on at least one of said sole, said crown and said skirt;

a first weight member and a second weight member, each configured to be coupled to said weight mount;

a single fastener configured to translate relative to said weight mount and engage said first weight member and said second weight member, coupling both said first weight member and said second weight member to said weight mount simultaneously;

wherein said first weight member slides in a direction substantially perpendicular to said translation of said fastener;

wherein said second weight member slides in a direction substantially perpendicular to said translation of said fastener.

18. The golf club head of claim 17, wherein said weight mount comprises a threaded bore, said single fastener is configured to engage said threaded bore, and said single fastener is configured to translate as said fastener rotates inside said threaded bore.

19. The golf club head of claim 18, wherein said weight mount comprises a first undercut and a second undercut, wherein said first weight member and said second weight member each include an abutment surface, wherein at least a portion of said abutment surface of said first weight member is received in said first undercut, wherein at least a portion of said abutment surface of said second weight member is received in said second undercut, wherein said first undercut, said second undercut, and said fastener are configured to prevent said first weight member and said second weight member from moving relative to said weight mount when said fastener is tightened down in said threaded bore, wherein said first weight member slides in a direction different than that of said second weight member as said fastener is tightened down in said threaded bore.

20. A golf club head, comprising:

a hosel;

a ball striking face;

a sole extending aftward from a lower edge of said striking face;

a crown extending aftward from an upper edge of said striking face;

a skirt extending between said sole and said crown;

a weight mount disposed on at least one of said sole, said crown and said skirt;

said weight mount comprising a first portion and a second portion;

a first weight member and a second weight member, each configured to be coupled to said weight mount;

a single fastener configured to force said first weight member to translate in a first direction towards said first portion of said weight mount and said second weight member to translate in a second direction towards said second portion of said weight mount;

wherein said first direction is different than said second direction; and wherein said fastener, said first portion of said weight mount, and said second portion of said weight mount are configured to limit said first weight member and said second weight member from moving relative to said weight mount.

* * * * *